US010761451B2

(12) United States Patent
Kato et al.

(10) Patent No.: US 10,761,451 B2
(45) Date of Patent: Sep. 1, 2020

(54) DEVELOPING APPARATUS FOR PROVIDING DEVELOPER TO AN IMAGE BEARING MEMBER AND IMAGE FORMING APPARATUS HAVING THE DEVELOPING APPARATUS

(71) Applicant: CANON KABUSHIKI KAISHA, Tokyo (JP)

(72) Inventors: Masahito Kato, Suntou-gun (JP); Hirokazu Fujino, Mishima (JP); Naoki Fukushima, Mishima (JP); Atsushi Toda, Fuji (JP); Daisuke Baba, Mishima (JP); Yosuke Kishi, Suntou-gun (JP); Masaki Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/440,109

(22) Filed: Jun. 13, 2019

(65) Prior Publication Data

US 2019/0384206 A1 Dec. 19, 2019

(30) Foreign Application Priority Data

Jun. 19, 2018 (JP) ..... 2018-116004

(51) Int. Cl.
*G03G 15/08* (2006.01)
*G03G 15/09* (2006.01)

(52) U.S. Cl.
CPC ..... *G03G 15/0808* (2013.01); *G03G 15/09* (2013.01); *G03G 2215/0609* (2013.01)

(58) Field of Classification Search
CPC ..... G03G 15/0808; G03G 15/09; G03G 2215/0609; G03G 15/0815; G03G 2215/0869
USPC ..... 399/272, 281
See application file for complete search history.

(56) References Cited

U.S. PATENT DOCUMENTS 4,903,634 A * 2/1990 Ono ..... G03G 15/081 399/281
5,073,797 A * 12/1991 Ono ..... G03G 15/0818 399/105
5,666,620 A * 9/1997 Kobayashi ..... G03G 15/0815 399/273

FOREIGN PATENT DOCUMENTS

JP 58176662 A * 10/1983 ..... G03G 15/09
JP 62030270 A * 2/1987
(Continued)

*Primary Examiner* — Robert B Beatty
(74) *Attorney, Agent, or Firm* — Rossi, Kimms & McDowell LLP

(57) ABSTRACT

A developing apparatus, includes: a developer bearing member that is rotatable; an moving member configured to move the magnetic developer carried on the developer bearing member before the magnetic developer is restricted by a restricting member, the moving member being rotatable and brought into contact with a surface of the developer bearing member; and a control portion, wherein, at a contact position between the developer bearing member and the moving member, assuming that a moving speed vector of a surface of the developer bearing member is taken as R and a moving speed vector of a surface of the moving member is taken as r, the control portion controls rotational operation of the developer bearing member and the moving member such that a direction of a vector R−r during image formation and a direction of a vector R−r during non-image formation be opposite to each other.

10 Claims, 21 Drawing Sheets

(56) References Cited

FOREIGN PATENT DOCUMENTS

| | | | | | |
|---|---|---|---|---|---|
| JP | 63109475 | A | * | 5/1988 | |
| JP | 07244423 | A | * | 9/1995 | |
| JP | 08054785 | A | * | 2/1996 | |
| JP | H0854785 | A | | 2/1996 | |
| JP | 2001066880 | A | * | 3/2001 | |
| JP | 2003084572 | A | * | 3/2003 | |
| JP | 2012128028 | A | * | 7/2012 | ..... G03G 15/086 |
| JP | 2014112266 | A | * | 6/2014 | |

* cited by examiner (MEASUREMENT RESULT A OF BRUSH CURRENT I)

| RESTRICTION FAILURE | – | ○ | △ |
|---|---|---|---|

(MEASUREMENT RESULT B OF BRUSH CURRENT I)

| | | |
|---|---|---|
| RESTRICTION FAILURE | ○ | △ |

DURING IMAGE FORMATION : |R|-|r| > 0

DURING NON-IMAGE FORMATION : |R|-|r| < 0 (R=0)

DURING NON-IMAGE FORMATION : |R|-|r| < 0

DURING IMAGE FORMATION : |R|-|r| > 0

DEVELOPING APPARATUS FOR PROVIDING DEVELOPER TO AN IMAGE BEARING MEMBER AND IMAGE FORMING APPARATUS HAVING THE DEVELOPING APPARATUS

BACKGROUND OF THE INVENTION

Field of the Invention

The present invention relates to a developing apparatus for developing an electrostatic latent image formed on a photosensitive drum, and an image forming apparatus for forming an image on a recording medium by using a developer.

Description of the Related Art

Conventionally, an electrophotographic image forming apparatus using a magnetic single-component developing configuration develops toner on an electrostatic latent image by using magnetic toner, a developing roller for bearing the magnetic toner, a fixed magnet disposed in the developing roller, and a developing blade for restricting the magnetic toner on the surface of the developing roller to a predetermined toner layer. The magnetic toner on the surface of the developing roller is present in the form of chains (the magnetic toner is hereinafter referred to as "magnetic chains") by a magnetic field of the fixed magnet. The magnetic chains are frictionally charged when restricted by the developing blade to obtain charge amount necessary for image formation.

However, the charge amount of toner tends to increase due to the recent increase in image quality of image forming apparatuses and improvement of development responsiveness. There is a problem in that the toner having high charge amount may be increased in electrostatic attachment force and easily stick to the developing roller surface and it is thus more difficult to restrict the toner by the developing blade.

As countermeasures for the problem, in conventional technology, before the toner sticking to the developing roller surface is restricted by the developing blade, a stripping member such as a fur brush and a sponge roller is brought into contact with the developing roller to strip the toner sticking to the developing roller surface. As a specific example thereof, Japanese Patent Application Publication No. H08-54785 indicates that a fur brush is brought into contact with a region where the magnetic field of a fixed magnet is weak (not a magnetic pole position where magnetic field is strong but an interpole region between adjacent magnetic poles) to improve cleaning (stripping) performance.

SUMMARY OF THE INVENTION

However, in the configuration in which the fur brush or the sponge roller is brought into contact with the developing roller to strip the toner, the stripping member mechanically rubs the toner, and hence there is a problem in that physical properties of toner may change due to a separated or buried external additive (hereinafter referred to as "toner deterioration"). When this problem occurs, the charge amount of toner decreases, and a problem of so-called fogging or density decrease occurs.

Thus, a developing apparatus capable of maintaining toner charge amount necessary for high-quality image formation and capable of suppressing a restriction failure caused by sticking of toner to a developing roller surface and suppressing toner deterioration has been sought after.

For the above-mentioned problem, the inventors of the present invention conducted a diligent study and found that the above-mentioned problem can be solved by, for example, disposing a brush-shaped moving member on the upstream side in the rotation direction with respect to the contact position of the restricting member in contact with the developing roller. However, in such a configuration, when time has elapsed from the previous image formation in the state in which toner becomes clogged near a contact nip between the moving member and the developing roller, a history thereof becomes image density unevenness, which causes another problem.

In order to achieve the object described above, a developing apparatus, including:

a developer bearing member that encloses a magnet roller having a plurality of magnetic poles and is rotatable;

a wall that forms a developer storing chamber for storing a magnetic developer therein;

a restricting member configured to restrict a layer thickness of the magnetic developer carried on the developer bearing member;

a moving member configured to move the magnetic developer carried on the developer bearing member before the magnetic developer is restricted by the restricting member, the moving member being rotatable and brought into contact with a surface of the developer bearing member, the moved developer being on the developer bearing member after the moving member moved the developer on the developer bearing member; and a control portion configured to control rotational operation of the developer bearing member and the moving member, wherein, at a contact position between the developer bearing member and the moving member, assuming that a moving speed vector of a surface of the developer bearing member is taken as R and a moving speed vector of a surface of the moving member is taken as r, the control portion controls rotational operation of the developer bearing member and the moving member such that a direction of a vector R−r during image formation and a direction of a vector R−r during non-image formation be opposite to each other.

Further features of the present invention will become apparent from the following description of exemplary embodiments with reference to the attached drawings.

DESCRIPTION OF THE EMBODIMENTS

Embodiments of the present invention are exemplified below with reference to the accompanying drawings. The dimensions, materials, shapes, and relative arrangement of components described in the embodiments should be appropriately changed depending on the configuration and various conditions of an apparatus to which the invention is applied, and are not intended to limit the scope of the invention to the following embodiments.

First Embodiment

In the first embodiment, modes for embodying the invention are described in the following order:

1. Outline of image forming apparatus;
2. Outline of developing apparatus including moving member; and
3. Description of operation sequence of developing roller and brush roller.

Outline of Image Forming Apparatus

Figure 1:
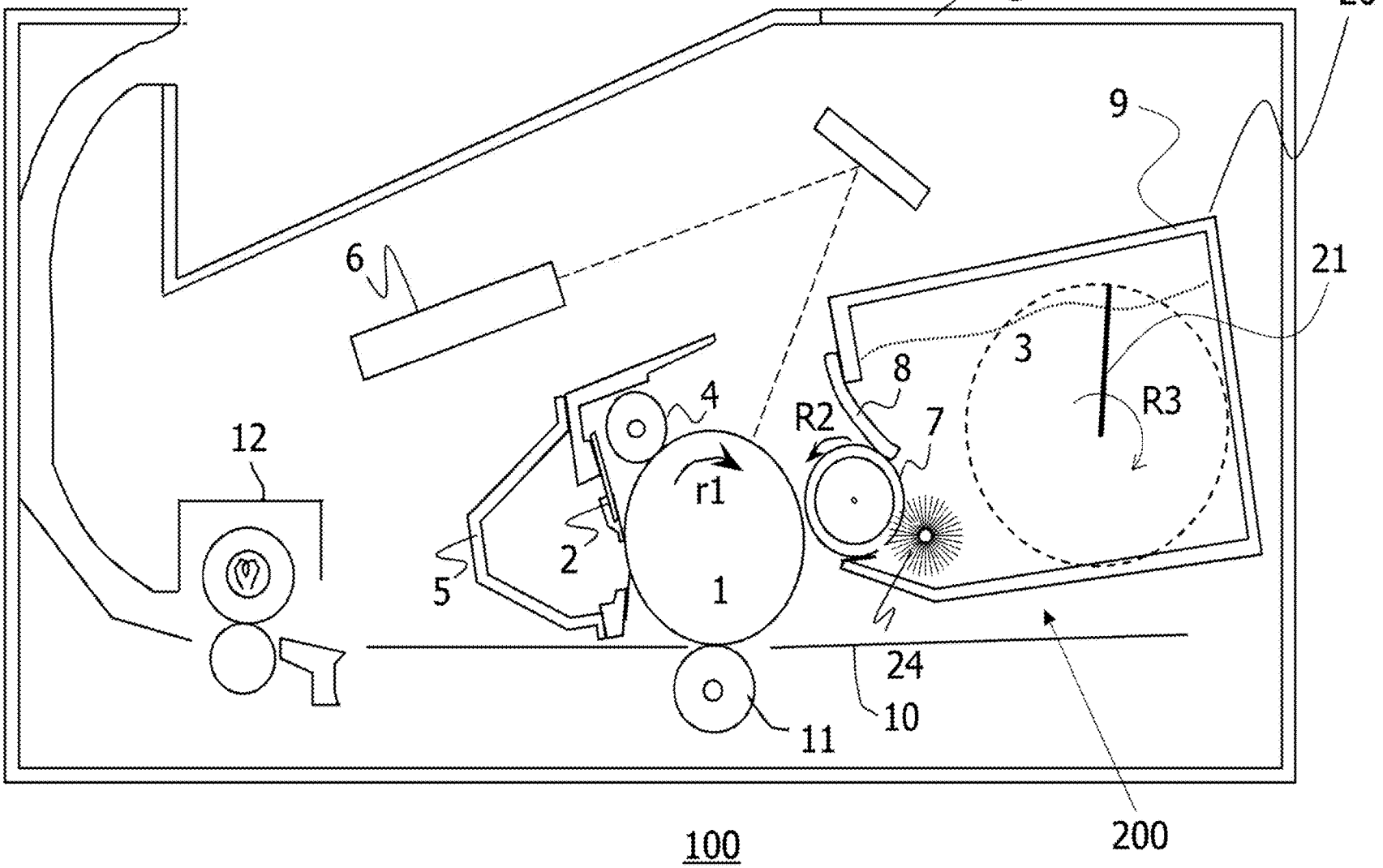
FIG. 1 is a cross-sectional diagram of an image forming apparatus according to a first embodiment.

FIG. 1 illustrates a cross-sectional view of an image forming apparatus 100 according to the first embodiment. In a main body M of the image forming apparatus 100, a photosensitive drum 1 serving as an image bearing member is provided as a member to be charged. The photosensitive drum 1 is obtained by forming an organic photosemiconductor (OPC) photosensitive layer on the outer peripheral surface of a conductive drum, and when a driving command is transmitted from the main body, the photosensitive drum 1 is rotationally driven in a direction denoted by r1 in the figures at predetermined process speed of 188 mm/sec. The surface of the photosensitive drum 1 is charged with predetermined polarity and potential by a charging roller 4 applied with a charging bias. The charged surface of the photosensitive drum 1 is scanned and exposed by a laser beam scanner 6 as exposure means, and an electrostatic latent image corresponding to intended image information is formed on the surface of the photosensitive drum 1. The electrostatic latent image is driven and transmitted in a direction indicated by r2 in the figures by a developing apparatus 20 including a developer container 9 and developing bias as developing means, a developing roller 7, a developing blade 8 as a restricting member for restricting the thickness of a toner layer, and a brush roller 24 as a moving member. In this manner, predetermined charge amount and toner layer (magnetic chains) are formed on the developing roller 7. The developer (toner) 3 is adhered to the photosensitive drum 1 by an electric field of the developing bias, and the electrostatic latent image is developed as a toner image. Specifically, when magnetic toner is supplied from the developing roller 7, an electrostatic latent image formed on the surface of the photosensitive drum 1 is developed, and a toner image is formed on the surface of the photosensitive drum 1. The magnetic toner is an example of a magnetic developer. The magnetic toner is hereinafter referred to as "toner 3".

A recording material 10 (paper) is fed by a paper feed roller, and a toner image is transferred onto the surface of the recording material 10 between the photosensitive drum 1 and a transfer roller 11 by transfer bias. The recording material 10 having the toner image transferred thereon is separated from the surface of the photosensitive drum 1 and conveyed to a fixing unit 12, and is heated and pressurized such that the toner image is fixed on the recording material 10. In the photosensitive drum 1 after the toner image is transferred, an untransferred developer (waste toner) remaining on the surface without being transferred to the recording material 10 is removed by a cleaning member 2 as cleaning means, and is stored in a cleaning container 5 as waste toner.

After that, the cleaned surface of the photosensitive drum 1 is charged and exposed again, and the developing roller 7 after development is supplied with toner 3 again from the developer container 9. After that, the transfer and fixation are repeated, and a cycle of a series of image formation is performed.

Figure 2:
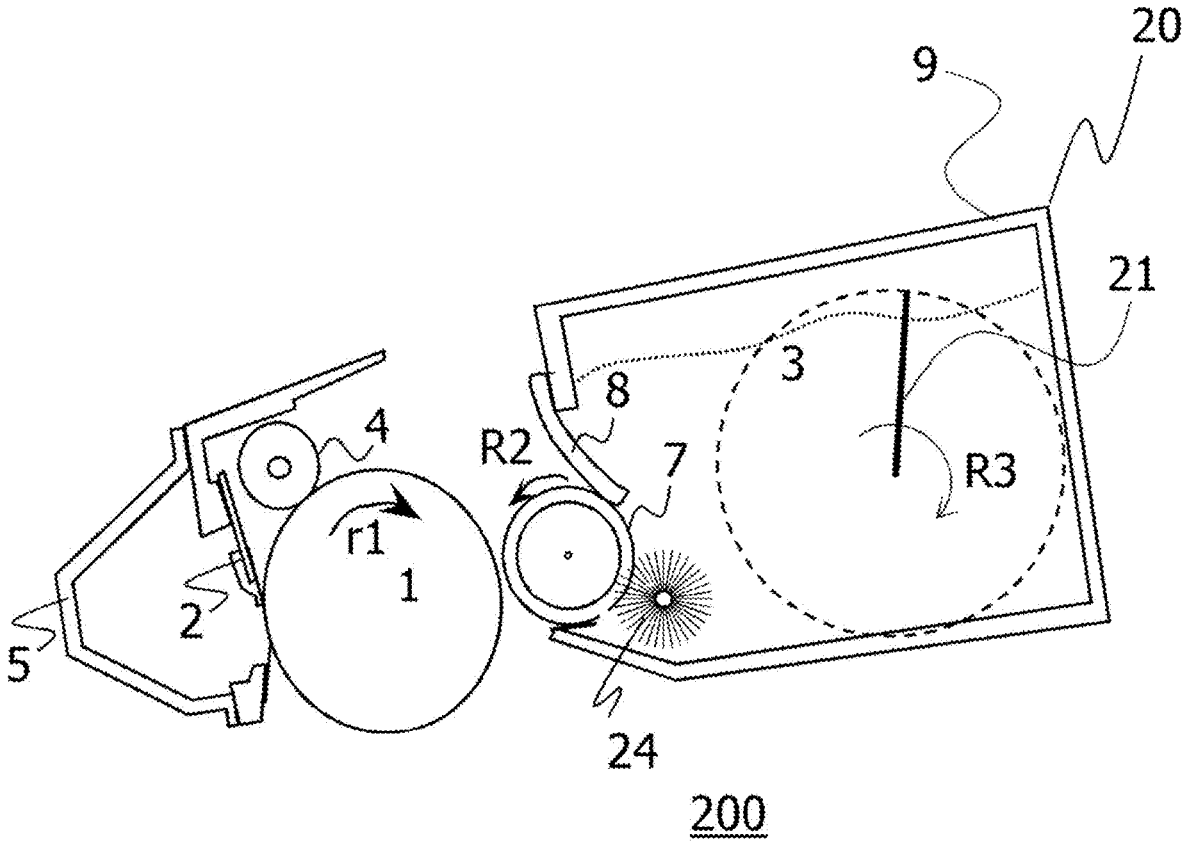
FIG. 2 is a cross-sectional diagram of a process cartridge according to the first embodiment.
Figure 3:
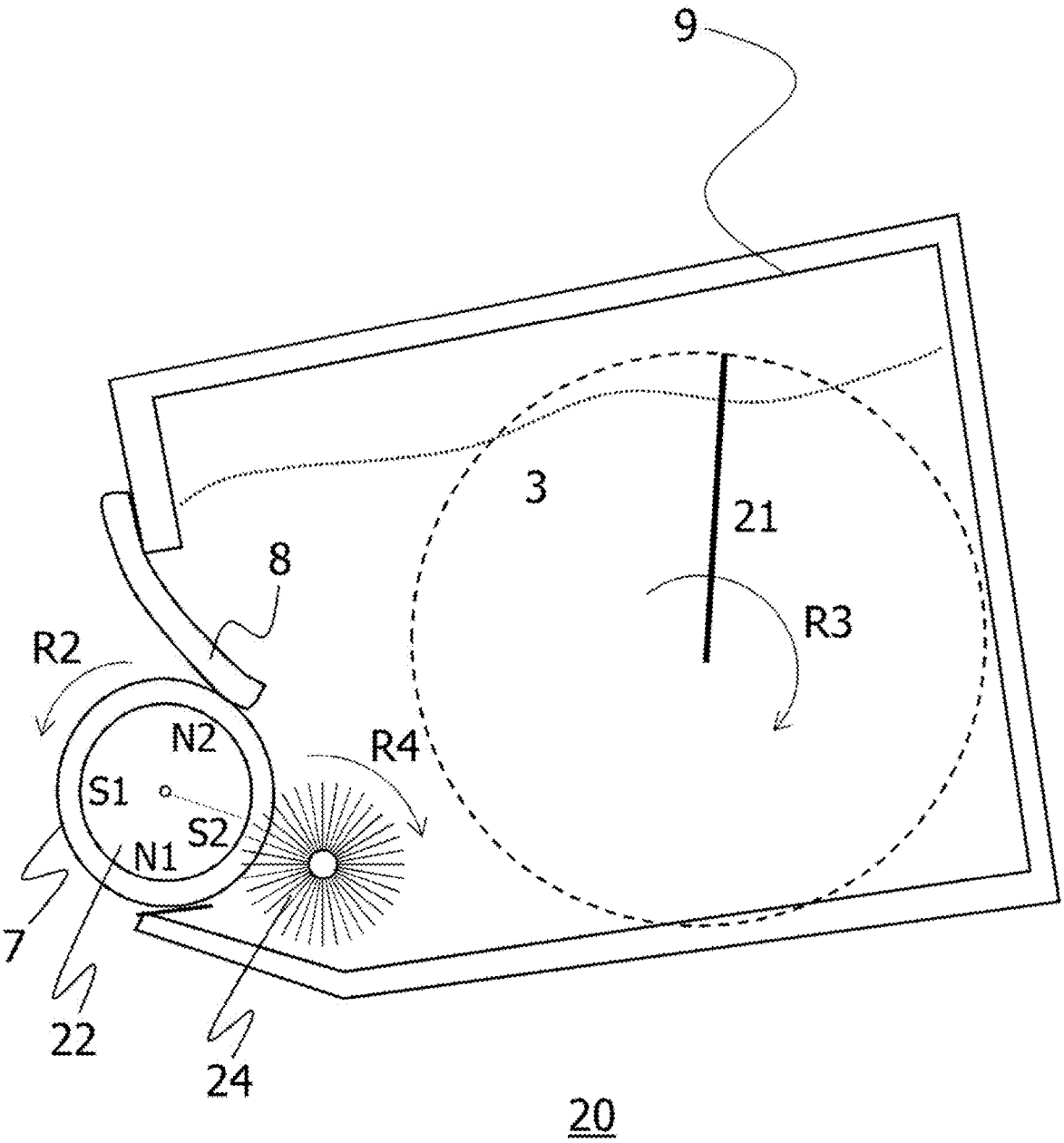
FIG. 3 is a cross-sectional diagram of a developing apparatus according to the first embodiment.

FIG. 2 is a cross-sectional view of a process cartridge 200 according to the first embodiment. FIG. 3 is a cross-sectional view of the developing apparatus 20 according to the first embodiment. In the image forming apparatus 100 according to this embodiment, the process cartridge 200 is formed by integrally incorporating a process device including the photosensitive drum 1, the charging roller 4, the developer container 9, and the cleaning container 5 to a cartridge container. The process cartridge 200 is removably provided to the main body M of the image forming apparatus 100.

Outline of Developing Apparatus Including Agitating Member

In the developing apparatus 20 in the first embodiment, the brush roller 24 is brought into contact with the developing roller 7 in the vicinity of a magnetic pole position of a magnet roller 22. In this manner, the toner layer on the developing roller 7 is not stripped by a brush of the brush roller 24 during driving of the developing roller 7, but the brush roller 24 is caused to reach the lowermost layer toner of magnetic chains to roll or move the lowermost layer toner.

The movement of the lowermost layer toner is expected to solve the problem of sticking of toner having high charge amount.

Next, the configuration of the developing apparatus including the brush roller 24 is described with reference to a cross-sectional view of the developing apparatus according to the first embodiment in FIG. 2. As illustrated in FIG. 2, the developer container 9 is provided with a toner storing chamber 40 for storing the toner 3 therein. The toner storing chamber 40 is an example of a developer storing chamber. The developing roller 7 is a rotatable developer bearing member that encloses the magnet roller 22 having a plurality of magnetic poles. The developing roller 7 has a developing sleeve 19 and the magnet roller 22. The developing sleeve 19 rotates in an R2 direction on an outer peripheral portion of the magnet roller 22. The magnet roller 22 is fixedly enclosed in the developing roller 7. The toner 3 is carried by the surface of the developing roller 7 (outer peripheral surface of developing sleeve 19) due to magnetic force of the magnet roller 22. The developing blade 8 restricts the layer thickness of the toner 3 on the developing roller 7.

The brush in the brush roller 24 is disposed so as to be opposed to the developing roller 7 such that the tip as a part of the brush is in contact with the surface of the developing roller 7 in the vicinity of the magnetic pole position of the magnet roller 22. The brush in the brush roller 24 is a fixed fur brush having ground fabric in which a plurality of brush fibers are transplanted. One end of each brush fiber is fixed to a fixed end (ground fabric 24*c* and core 24*b* described later) of the moving member, and the other end thereof is a free end. The brush in the brush roller 24 moves the toner 3 carried on the surface of the developing roller 7 before restriction of the toner 3 by the developing blade 8. A toner conveying member 21 is provided inside the toner storing chamber 40. When the toner conveying member 21 is rotationally driven in an R3 direction, the toner conveying member 21 conveys the toner 3 toward a direction in which the developing roller 7 and the brush are disposed.

Main parameters in the first embodiment are listed below.

(Developing Roller 7)
Outer diameter: 18 mm
Material: Metallic system (nickel/aluminum/SUS)
Surface roughness: Ra 0.2 to 1.0 μm
Revolving speed: 188 mm/sec
Spacing between photosensitive member and drum: 0.3 mm
(Developing Blade 8)
Material: Urethan
Thickness: 1.0 mm
(Toner 3)
Material: Styrene acryl
Specific gravity: 1.6 g/cm$^3$
Weight-average particle diameter: 7 μm The weight-average particle diameter of the toner 3 is calculated by a measuring apparatus. As the measuring apparatus, a precise particle counting and sizing apparatus "Coulter Counter Multisizer 3" (registered trademark, manufactured by Beckman Coulter, Inc.) using a hole electric resistance method provided with an aperture tube of 100 μm is used.

The magnetic pole positions of the magnet roller 22 mainly include the position of a development pole (S1 pole) and the position of a toner moving pole (S2 pole). The position of the development pole (S1 pole) of the magnet roller 22 is near a position at which the magnet roller 22 and the photosensitive drum 1 are opposed to each other. The position of the toner moving pole (S2 pole) of the magnet roller 22 is inside the developer container 9. The brush in the brush roller 24 in the first embodiment is in contact with near the position of the toner moving pole (S2 pole) on the upstream side in the rotation direction of the developing roller 7 restricted by the developing blade 8. In FIG. 2, when it is assumed that the vertically downward direction from the center of the magnet roller 22 is 0° and the angle increases from 0° in the counterclockwise direction, the position of the S2 pole in the first embodiment is 70°.

Figure 4A:
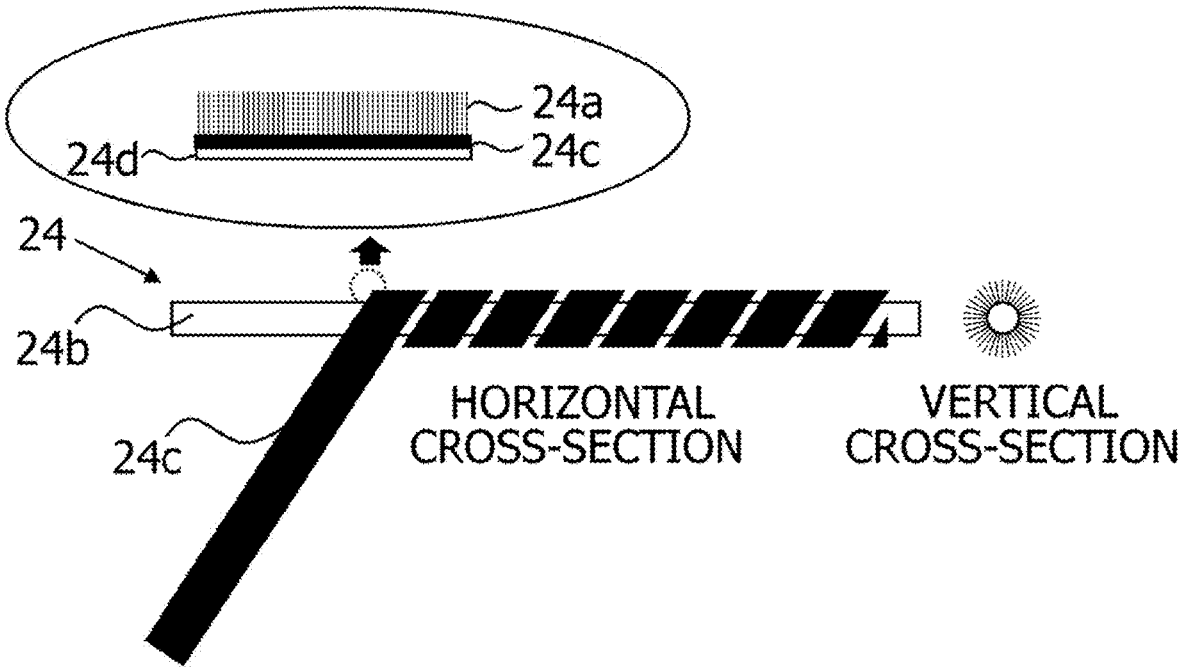
FIG. 4A and FIG. 4B are schematic diagrams of an moving member according to the first embodiment.
Figure 4B:
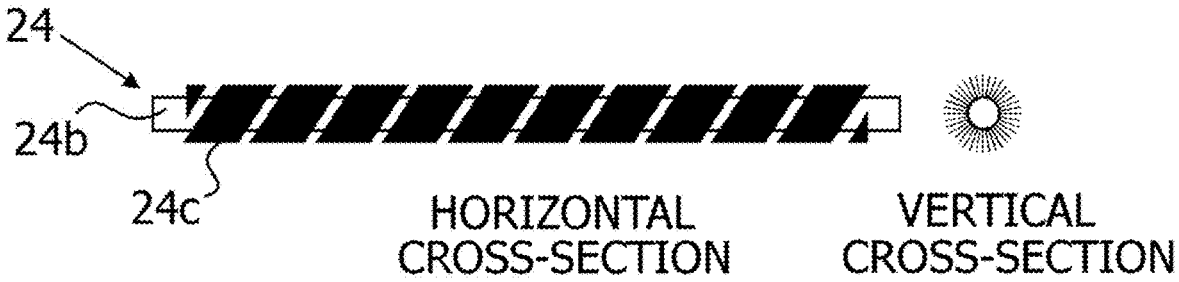

Next, the configuration of the brush roller 24 as a moving member in the first embodiment is described. As illustrated in FIG. 4A and FIG. 4B, the brush roller 24 in the first embodiment is a brush roller having a unit configuration in which a ground fabric 24*c* transplanted with a plurality of brush fibers 24*a* is provided, double-sided tape 24*d* is bonded to the bottom surface of the ground fabric 24*c*, and the resultant is spirally wound around a core 24*b* to have a roller shape. The core 24*b* is a columnar rotating shaft. The brush roller 24 is a fur brush in which the brush fibers 24*a* are provided on the peripheral surface of the rotating shaft. The ground fabric 24*c* is an example of a support member for supporting a brush. The ground fabric 24*c* is wound around the core 24*b*, and is thus rotatably provided to the brush roller 24. In this manner, the brush fibers in the brush roller 24 is fixed to a fixed end formed from the ground fabric 24*c* and the core 24*b*.

FIG. 4A illustrates the state in which the ground fabric 24*c* is being wound around the core 24*b*. FIG. 4B illustrates the state after the ground fabric 24*c* is wound around the core 24*b*. The diameter of the core 24*b* is 5 mm, and the fiber length starting from the ground fabric 24*c* of each fiber is 1 to 5 mm. The tip of the brush fiber 24*a* is a free end, and in this example, the inroad amount of a raised portion to the outer peripheral surface of the developing roller 7 is set to 0.5 to 1.0 mm.

The material of the brush roller 24 is conductive, and the fiber height, the fineness, the fiber density, and a weaving method as physical properties of the brush may have any value similarly to the first embodiment as long as the brush roller 24 has a roller shape and is capable of moving the toner. The material of the core 24*b* is SUS, which is conductive. The core 24*b* is conductive to the brush fibers 24*a* at end portions thereof. The core 24*b* is also connected to the developing roller 7 through an electric circuit, and hence the brush fibers 24*a* and the developing roller 7 have the same potential.

Figure 5:
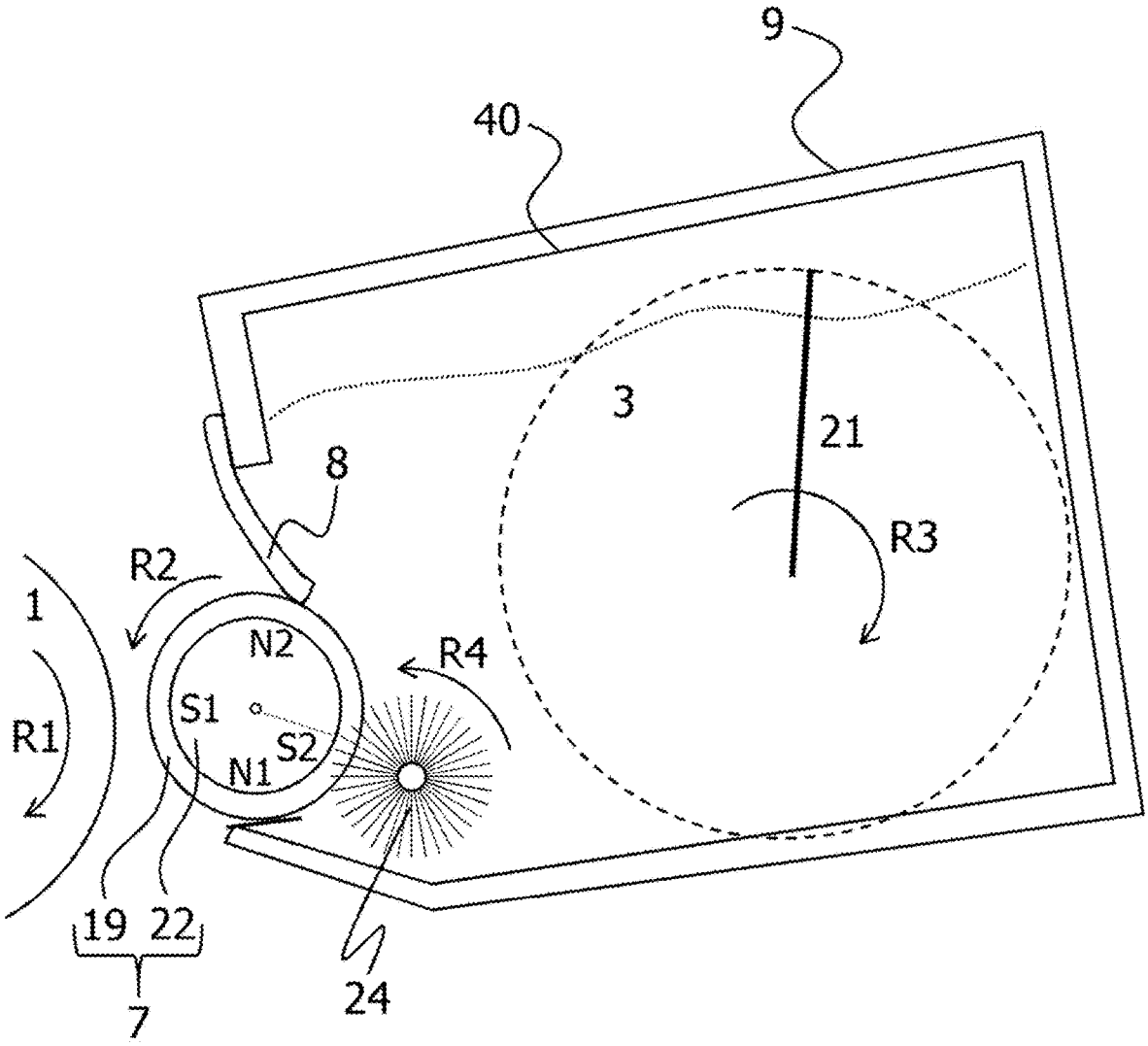
FIG. 5 is another cross-sectional diagram of the developing apparatus according to the first embodiment.

Next, a configuration of a developing apparatus including the brush roller 24 in the first embodiment is described with reference to FIG. 5. First, in regard to the contact state, the brush roller 24 is disposed such that the tip of the brush fiber 24*a* on the outer circumference is in contact with the surface of the developing roller 7 near the magnetic pole position of the magnet roller 22. In addition, the position of the core 24*b* is determined such that the tip of the brush fiber 24*a* on the outer circumference of the brush roller 24 is in contact with the surface of the developing roller 7 near the magnetic pole position of the magnet roller 22. The brush roller 24 rotates at a peripheral speed of 100 rpm. The developing roller 7 and the brush roller 24 rotate in opposite directions at a contact position between the developing roller 7 and the brush roller 24. As illustrated in FIG. 5, the brush roller 24 is disposed at a position opposed to any magnetic pole position among a plurality of magnetic poles of the magnet roller 22. For example, the contact position of the brush roller 24 with the developing roller 7 is opposed to any of the magnetic pole positions among the plurality of magnetic poles of the magnet roller 22.

In the first embodiment, the developing roller 7 and the brush roller 24 are driven with instructions transmitted from different driving sources, and are rotationally driven with different numbers of rotations during image formation. The developing roller 7 and the brush roller 24 can be driven and stopped at any timing. However, the developing roller 7 and the brush roller 24 are not necessarily required to be driven by different driving sources. For example, a clutch may be provided in the middle of a driving transmission path such that the driving and stop timings of the developing roller 7 and the brush roller 24 are controlled.

In the first embodiment, conductive nylon fibers in which carbon powder is dispersed are used as the conductive fibers serving as a raised portion. As the fibers, fibers having a single fiber fineness of 2 to 15 dtex [dtex: indicating a mass (unit: grams) per single-fiber 10,000 meters], a diameter of 10 to 40 μm, and a dry strength of 1 to 3 cN/dtex is preferred. The preferable resistivity pfiber of the fibers is 10 to $10^8$ Ωcm. The resistivity pfiber is measured by the following method. For example, 50 fibers are bundled into one, and a metal probe is brought into contact with the surface of the bundle with an interval of about 1 cm. A high resistance meter Advantest R8340A (manufactured by ADVANTEST CORPORATION) is used to actually measure a resistance value Rfiber under an applied voltage of 100 V to calculate the resistivity pfiber.

The fiber length starting from a ground fabric portion of each fiber is 1 to 5 mm. In this example, the fiber length is set such that the inroad amount of a raised portion to the outer peripheral surface of the developing roller 7 is 0.5 to 1.0 mm. The fiber material serving as the raised portion is not limited to nylon fiber as long as the material is conductive.

The configuration of the brush in the brush roller 24 and the entry amount in the developing roller 7 should be changed appropriately depending on an image forming apparatus to be used, and are not limited to the above-mentioned configuration and numerical values. In addition, the physical properties of the brush include the fiber height, the fineness, the fiber density, and a weaving method, and any material can be used as long as the brush does not strip the toner 3 on the developing roller by development driving but can move the toner lowermost layer.

Examples of parameters contributing to moving force include, in addition to the charge amount of the toner 3, the force (rotation speed) due to rotational motion of the developing roller, the magnetic force of the magnet roller 22, and physical properties of the brush (pressing pressure of brush). Thus, the balance of the forces is important as a moving condition. In the first embodiment, the following Expression (1) is provided in order to clearly specify that the brush in the brush roller 24 as a moving member is disposed for the purpose of moving the lowermost layer toner rather than stripping a toner layer on the developing roller 7.

$$Fblade/Cblade < Fbrush/Cbrush \quad (1)$$

Fblade: magnetic attractive force of magnet roller at restricting position

Cblade: restricting force of blade at restricting position

Fbrush: magnetic attractive force of magnet roller at brush contact position

Cbrush: restricting force of brush at brush contact position

The restricting position is a contact position of the developing blade 8 with the developing roller 7. The brush contact position is a contact position of the brush in the brush roller 24 with the developing roller 7. The left side "Fblade/Cblade" in Expression (1) represents "(magnetic attractive force of magnet roller at restricting position)/(restricting force of blade at restricting position)". The left side in Expression (1) is obtained by dividing "Fblade", which attracts the toner layer on the developing roller 7 toward the developing roller 7, by "Cblade", which strips the toner layer on the developing roller 7 from the developing roller 7. The left side in Expression (1) is an index indicating how much the toner layer tends to remain at a restricting position (between developing roller 7 and developing blade 8) and how much the toner layer is less peeled off (stripped).

The right side "Fbrush/Cbrush" in Expression (1) represents "(magnetic attractive force of magnet roller at brush contact position)/(restricting force of brush at brush contact position)". The right side in Expression (1) is an index indicating how much the toner layer tends to remain at the brush contact position (between developing roller 7 and brush in brush roller 24) and how much the toner layer is less peeled off (stripped). Expression (1) indicates that "how much the toner layer is less stripped at the brush contact position" is larger than "how much the toner layer is less stripped at the restricting position". Expression (1) indicates that the toner layer is less stripped by the brush at the brush contact position.

As specific values of "Cblade (restricting force of blade)" and "Cbrush (restricting force of brush)", "Pblade (linear pressure of blade)" and "Pbrush (linear pressure of brush)" can be used. The following Expression (2) may be used instead of Expression (1).

$$Fblade/Pblade < Fbrush/Pbrush \quad (2)$$

Pblade: linear pressure of blade at restricting position

Pbrush: linear pressure of brush at brush contact position

In the first embodiment, the blade linear pressure is set to 25 to 30 gf, the brush linear pressure is set to 15 to 20 gf, and the brush linear pressure is set to a value lower than that of the blade linear pressure. The linear pressure as used herein is a force itself as understood from the unit "gf". A method of measuring the linear pressure is described. A contact pressure (blade linear pressure) of the developing blade 8 is a value determined by the following procedure. For example, three SUS sheets (thickness: 50 μm, width: w [cm]) are inserted between the contact nip between the developing roller 7 and the developing blade 8 without toner, and a spring pressure F [gf] obtained when the middle SUS sheet is pulled out is measured. A friction coefficient μ between the SUS sheets is measured. Then, contact pressure (linear pressure) $P=\mu F/w$ is measured. The contact pressure (brush linear pressure) of the brush is also a value determined by the same procedure. For example, the brush is caused to enter the developing roller 7 by 1 mm without toner, and the above-mentioned three SUS sheets are inserted between contact nips.

The purpose of the brush in the brush roller 24 used in the first embodiment is to move the toner layer on the developing roller 7, not to strip the toner layer on the developing roller 7. Thus, the brush in which the density of hair (brush fiber) of the brush is "sparse" with respect to the density of magnetic chains is used. For example, it is considered that when the density of hair of the brush is "dense" with respect to the density of magnetic chains, the effect of stripping a toner layer on the surface of the developing roller increases. In such a case, the brush restricting force is considered to be substantially the same as the blade restricting force. However, in such a situation, excessive load is applied to the toner 3, which is not preferred in terms of deterioration of the toner 3. In other words, the conditional expressions of Expression (1) and Expression (2) are on the assumption that the density of hair (brush fiber) of the brush roller 24 as a moving member is sparse. The moving member is achieved by (i) a configuration in which the brush roller 24 has a plurality of brush fibers, and each brush fiber has one end fixed to a fixed end including the ground fabric 24*c* and the other end being a free end, and (ii) magnetic chains of toner described later.

In the state in which the brush is brand-new with not attachment on its surface, the influence of stripping may become larger than that of movement. However, the brush immediately becomes a steady state and the influence of movement becomes larger than that of stripping, and hence descriptions of minor stripping in the brand-new state are herein omitted.

Agitation of Magnetic Chains

Next, a mechanism for moving magnetic chains in this embodiment is described. Prior to the description, a configuration in a comparative example in which <1> the brush tip 26 of the brush roller 24 cannot come into contact with the surface of the developing roller 7 and <2> the movement of magnetic chains does not occur is described.

Figure 11:
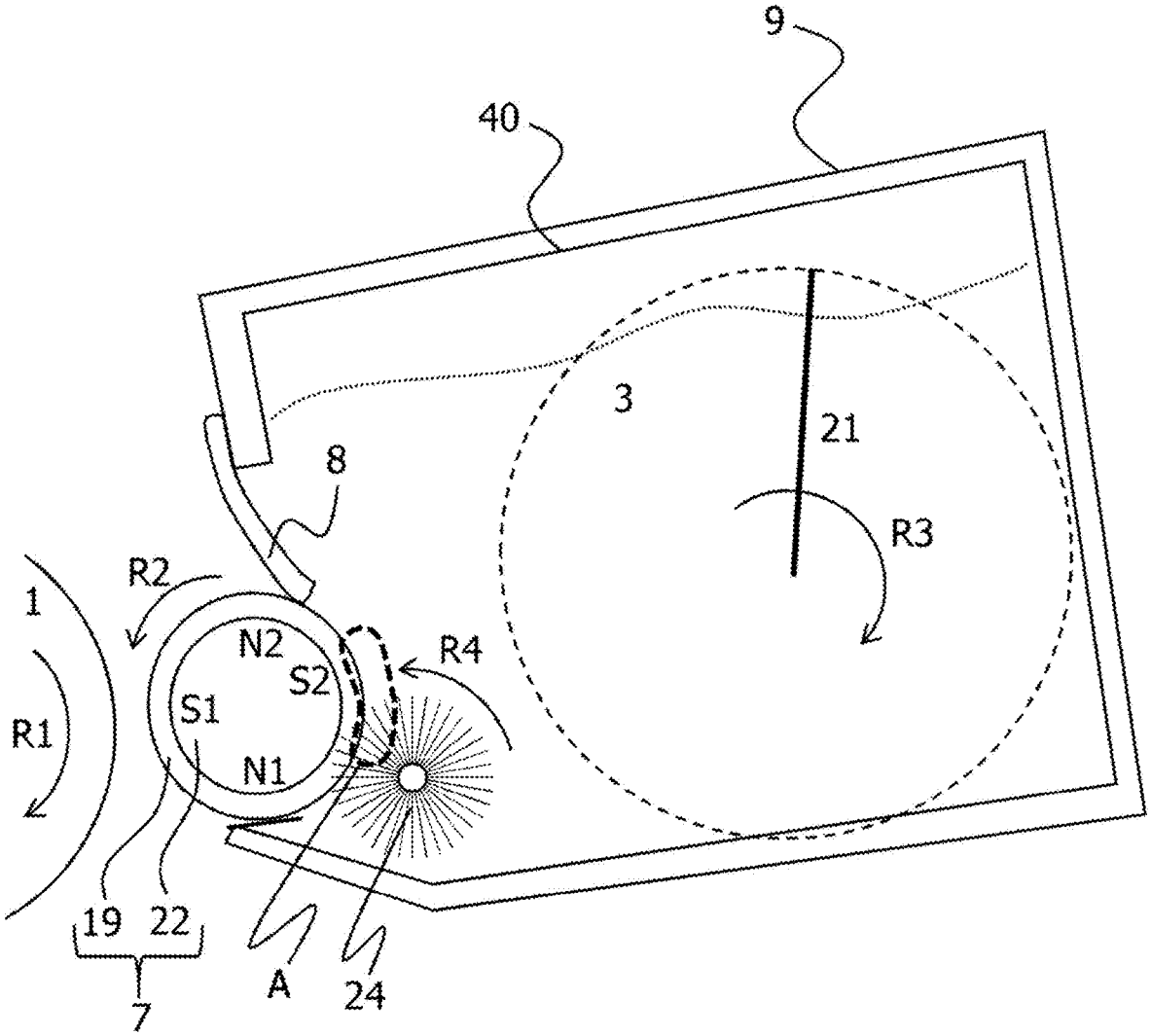
FIG. 11 is a cross-sectional diagram of a developing apparatus according to a comparative example.
Figure 12:
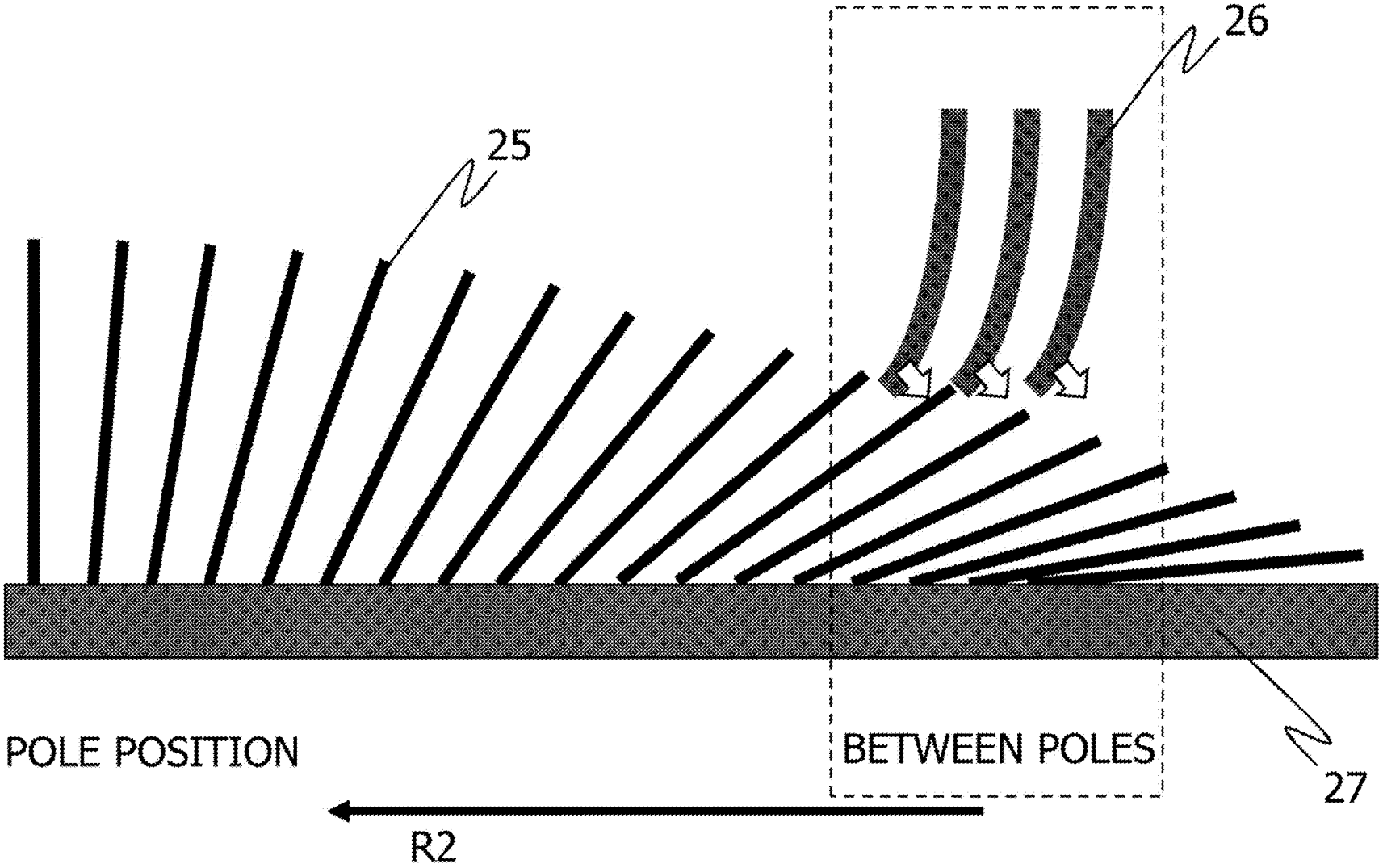
FIG. 12 is a relationship diagram of a brush in the developing apparatus and magnetic chains according to the comparative example.

First, the configuration in the comparative example in which <1> the brush tip 26 of the brush roller 24 cannot come into contact with the surface of the developing roller 7 is described with reference to FIG. 11 and FIG. 12. FIG. 11 is a cross-sectional diagram of a developing apparatus according to the comparative example. As illustrated in FIG. 11, a contact position between the developing roller 7 and the brush roller 24 is near a position between poles of the magnet roller 22. FIG. 12 is a relationship diagram of the brush roller 24 and the magnetic chains 25 in the developing apparatus according to the comparative example, illustrating the state of the magnetic chains 25 near a contact position (broken line portion A) between the developing roller 7 and the brush roller 24 in FIG. 11. When the magnetic chains 25 as a toner layer are located near the position between poles of the magnet roller 22, the magnetic chains 25 are present while being inclined along a magnetic field (magnetic line) of the magnet roller 22 (part surrounded by broken line in FIG. 12).

Figure 13A:
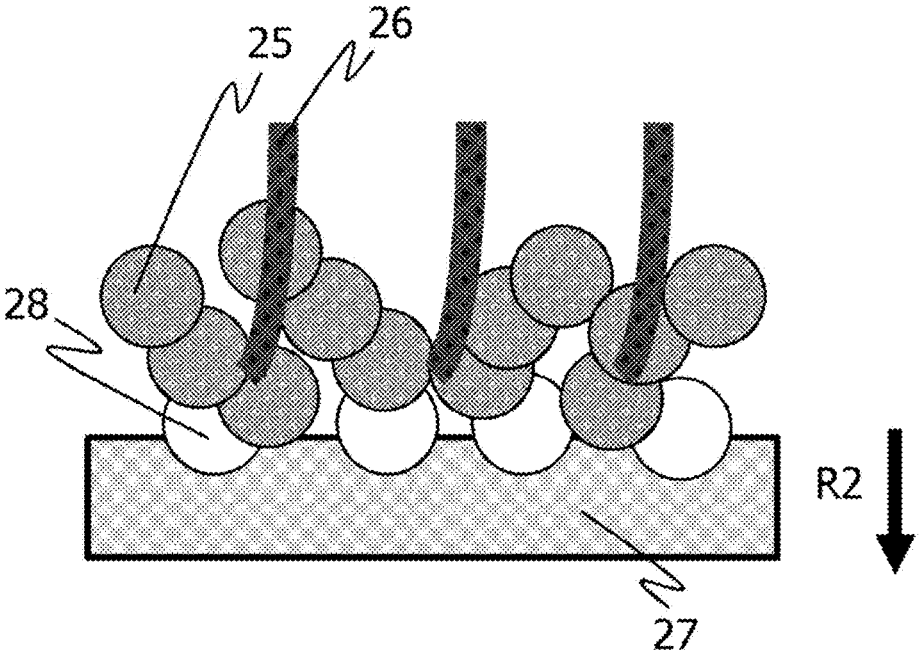
FIG. 13A and FIG. 13B are diagrams illustrating magnetic chains between magnetic poles in the configuration of the comparative example.
Figure 13B:
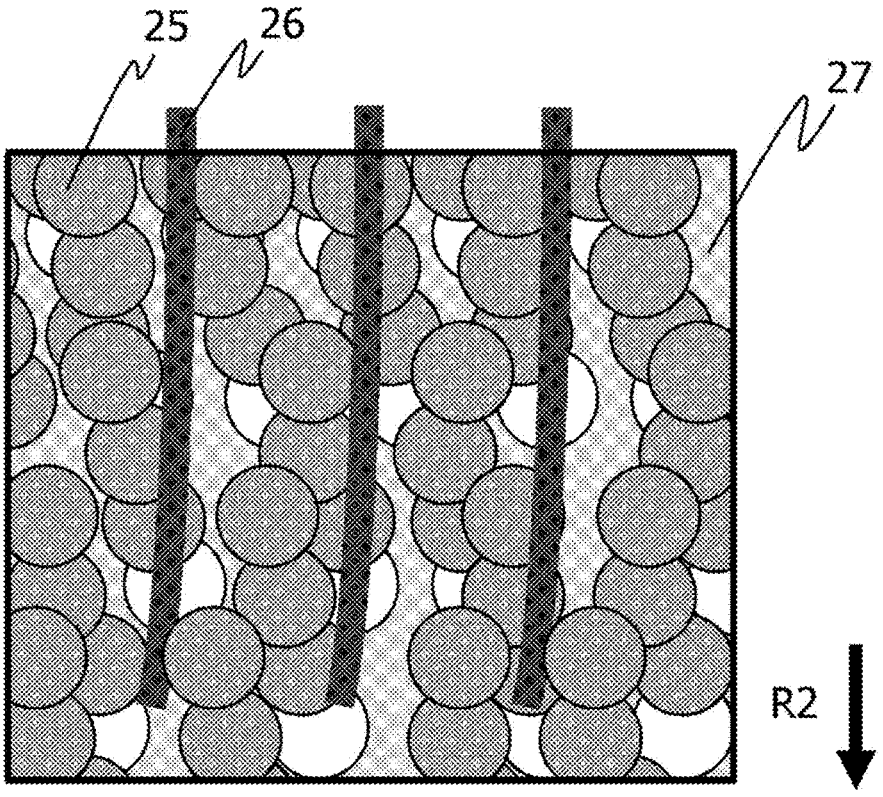

FIG. 13A is a diagram of magnetic chains 25 between magnetic poles in the configuration in the comparative example as seen from the side of the developing roller 7. FIG. 13B is a diagram of magnetic chains 25 at a magnetic pole position in the comparative example as seen from above the surface of the developing roller 7. On the surface of the developing roller 7, the magnetic chains 25 between magnetic poles described above are dense when seen from the above. In other words, the gap among the magnetic chains 25 is narrow (developing roller surface 27 is not seen through). Thus, the brush tip 26 cannot enter the lower side of the magnetic chains 25 and cannot come into contact with the developing roller surface 27 on the lower side of the toner layer.

Figure 14A:
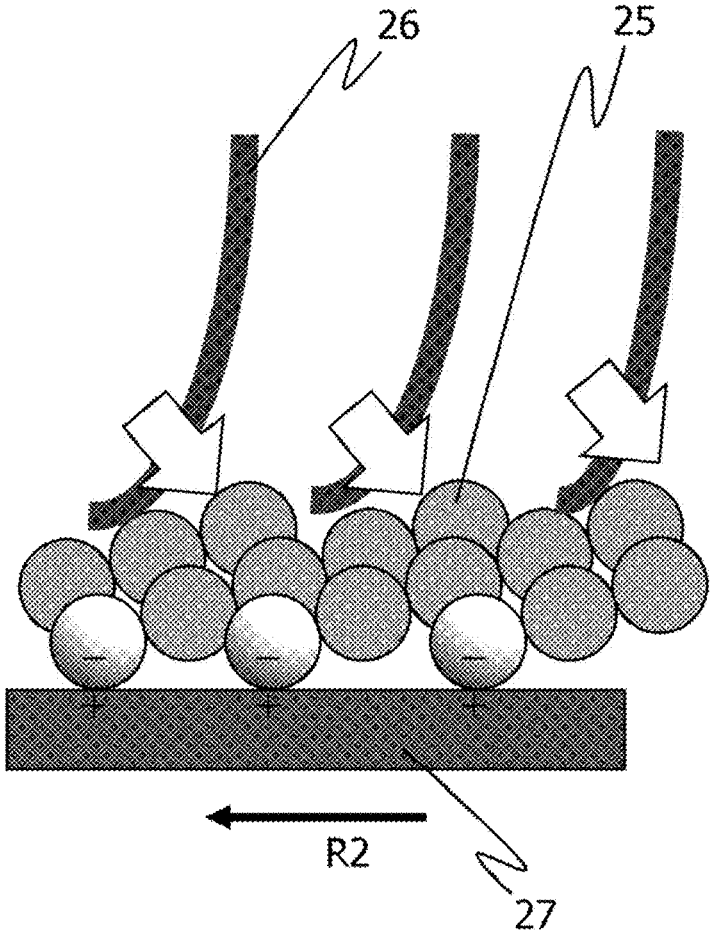
FIG. 14A and FIG. 14B are relationship diagrams of the brush in the developing apparatus and magnetic chains according to the comparative example.
Figure 14B:
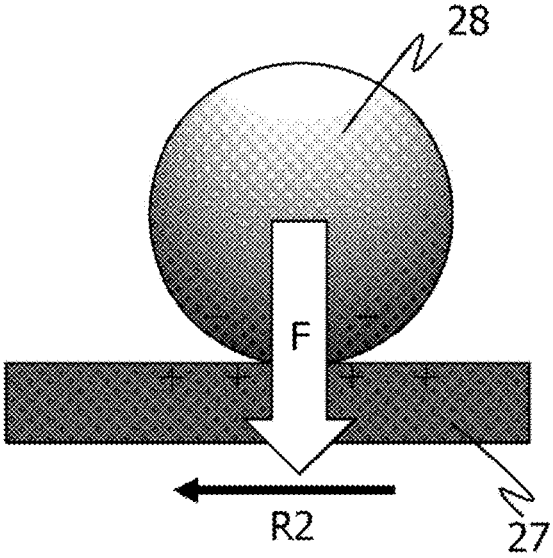

Next, the configuration in the comparative example in which <2> the movement of magnetic chains does not occur is described with reference to an enlarged diagram of magnetic chains 25 in FIG. 14A and an enlarged diagram of a lowermost layer toner 28 in FIG. 14B. In the state in which the toner 3 on the developing roller 7 is inclined as magnetic chains 25 between magnetic poles, the brush tip 26 cannot come into contact with the developing roller surface 27 and the lowermost layer toner 28 of the magnetic chains 25. In such a state, even when the developing roller 7 is driven in the developing roller rotation direction R2, a force of moving the lowermost layer toner 28 of the magnetic chains 25 does not act, and the lowermost layer toner 28 in the magnetic chains 25 cannot be moved. As a result, the lowermost layer toner 28 of the magnetic chains 25 cannot be moved by the brush 23, and the force by which the lowermost layer toner 28 adheres to the developing roller surface 27 (reflection force, arrow F) cannot be weakened. In other words, the toner 3 having high charge amount easily sticks to the surface of the developing roller 7 due to an increased electrostatic attachment force. The toner 3 having high charge amount on the developing roller surface 27 more attracts the toner 3 having low charge amount, and it is more difficult to restrict the toner 3 by the developing blade 8 and a restrict failure more easily occurs.

Next, the configuration in the first embodiment in which <3> the brush tip 26 of the brush roller 24 can come into contact with the surface of the developing roller 7 and <4> the movement of magnetic chains 25 occurs is described.

Figure 6:
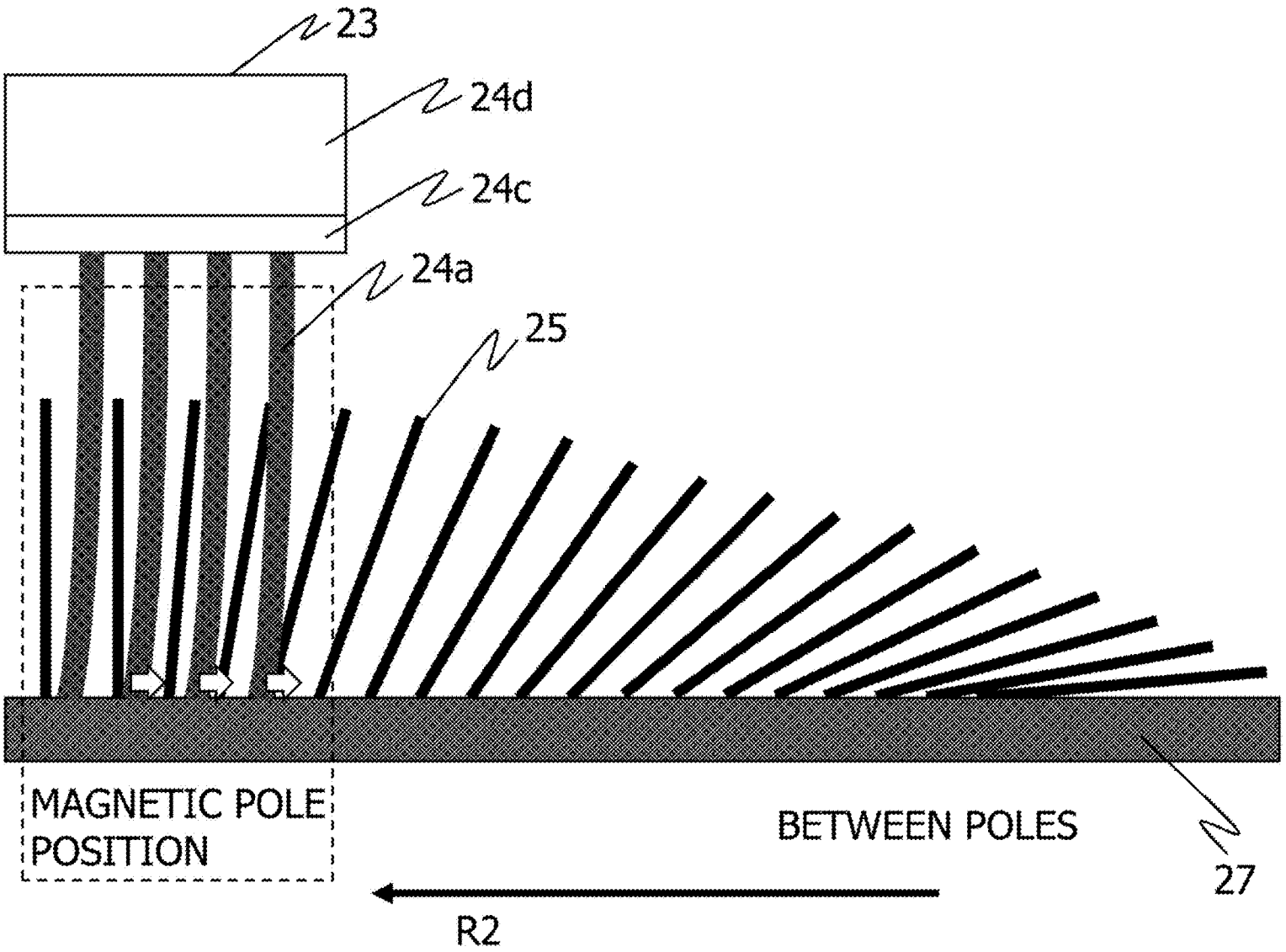
FIG. 6 is a relationship diagram of a brush in the developing apparatus and magnetic chains according to the first embodiment.
Figure 7A:
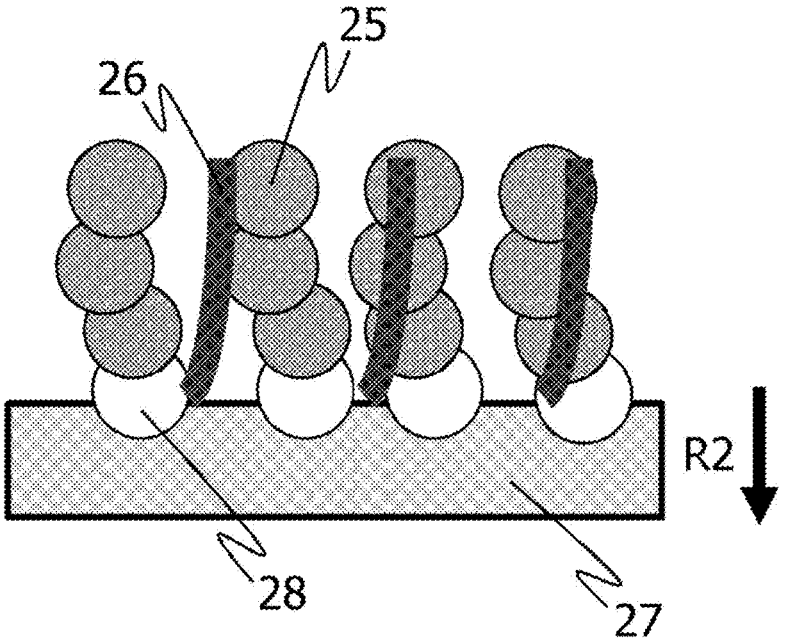
FIG. 7A and FIG. 7B are diagrams illustrating magnetic chains at a magnetic pole position in the configuration of the first embodiment.
Figure 7B:
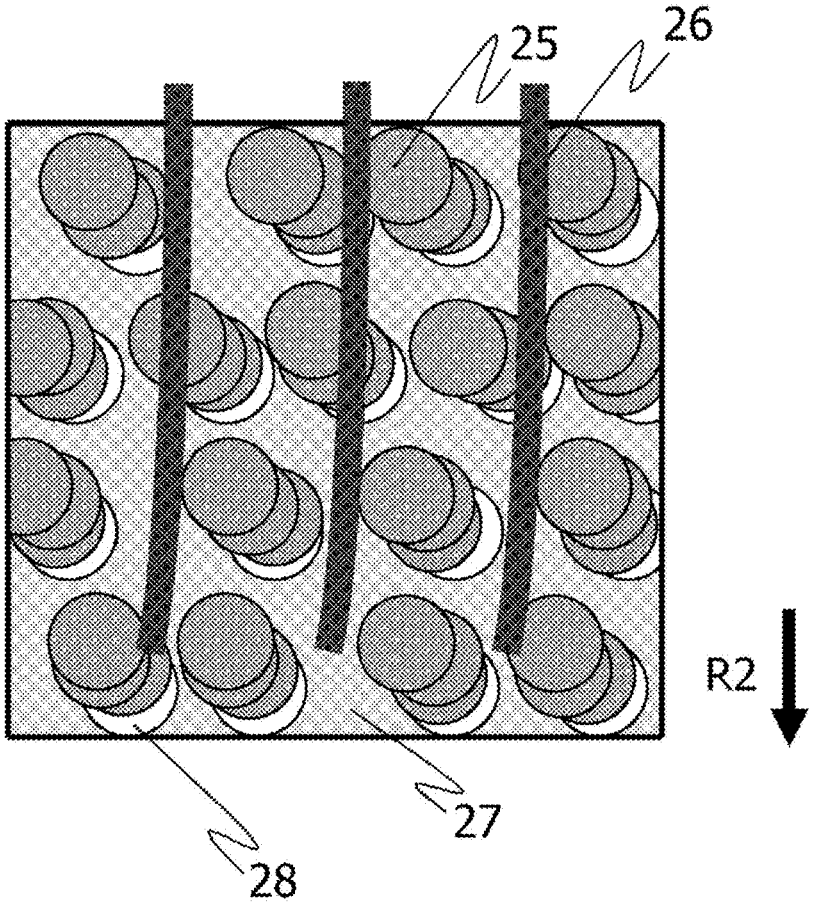

First, the configuration in the first embodiment in which <3> the brush tip 26 can come into contact with the surface of the developing roller 7 is described with reference to FIG. 6. FIG. 6 is a relationship diagram of the brush roller 24 and the magnetic chains 25 in the developing apparatus in the first embodiment, illustrating the state of magnetic chains 25 near a contact position between the developing roller 7 and the brush roller 24 in FIG. 5. When the magnetic chains 25 as a toner layer are located near a magnetic pole position of the magnet roller 22, the toner 3 is concentrated along a magnetic field (magnetic line) of the magnet roller 22. Thus, the magnetic chains 25 in the state in which the toner 3 is upright in the form of chains from the developing roller surface 27 are formed (part surrounded by broken line in FIG. 6). FIG. 7A is a diagram of magnetic chains 25 at the magnetic pole position in the configuration in the first embodiment as seen from the side of the developing roller 7. FIG. 7B is a diagram of magnetic chains 25 at the magnetic pole position in the configuration in the first embodiment as seen from above the surface of the developing roller 7. The gap among the magnetic chains 25 at the magnetic pole position described above is long when seen from above the surface of the developing roller 7. In other words, the gap among the magnetic chains 25 is wide (developing roller surface 27 is seen), and hence the brush tip 26 can enter the lower side of the magnetic chains 25 to come into contact with the lower side of the toner layer.

Figure 8A:
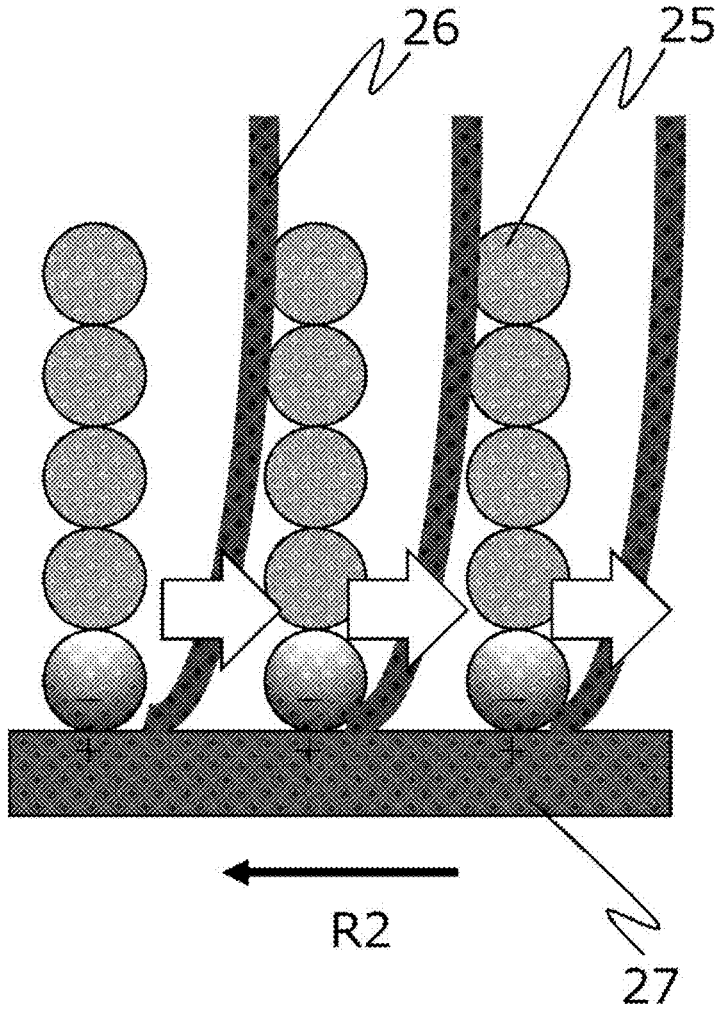
FIG. 8A is a relationship diagram of the brush in the developing apparatus and magnetic chains according to the first embodiment.
Figure 8B:
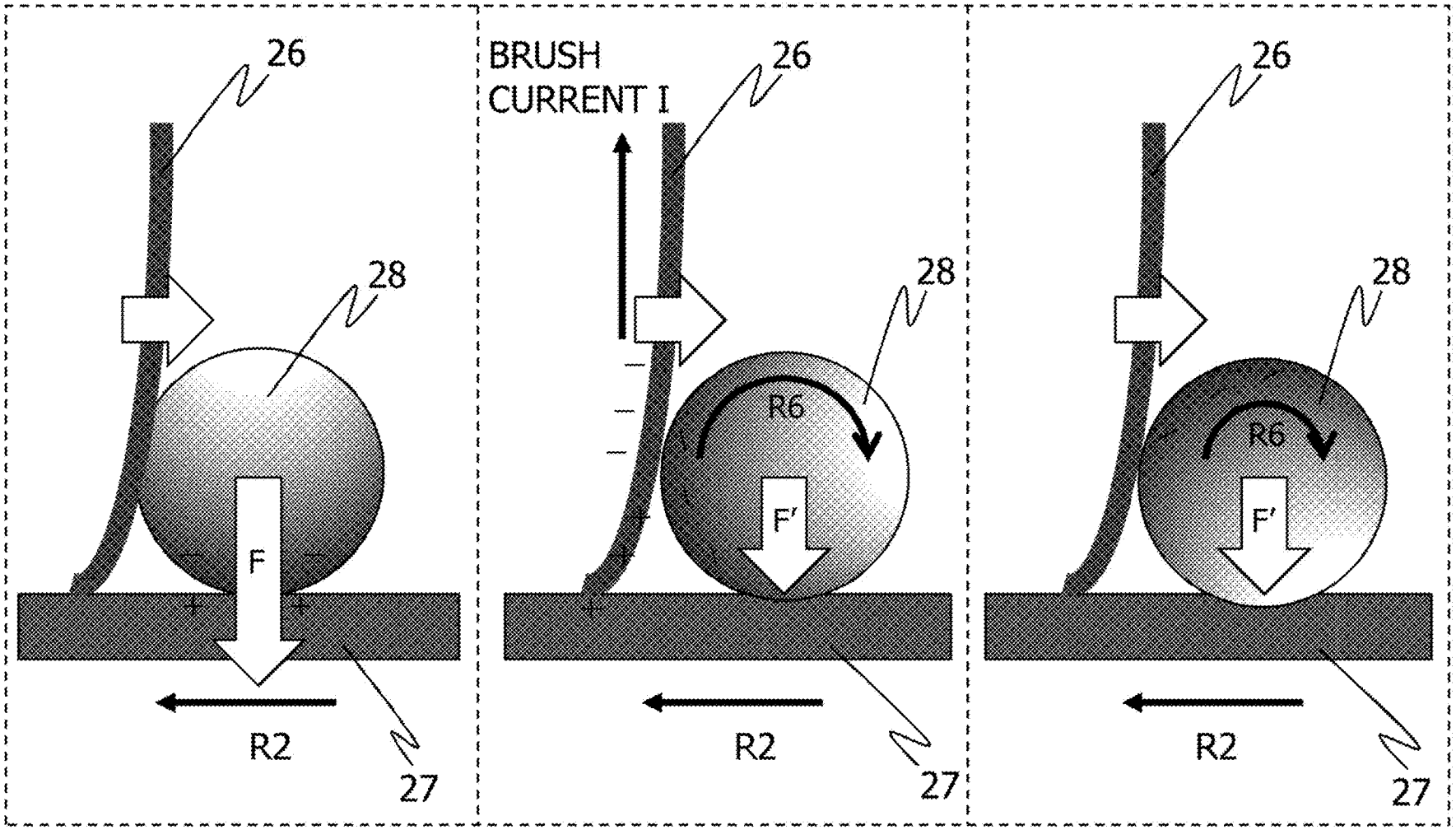
FIG. 8B is a relationship diagram of the brush in the developing apparatus and magnetic chains according to the first embodiment.

Next, the configuration in the first embodiment in which <3> the movement of magnetic chains 25 occurs is described with reference to an enlarged diagram of magnetic chains 25 illustrated in FIG. 8A and an enlarged diagram of a lowermost layer toner 28 illustrated in FIG. 8B. In the state in which the toner 3 on the developing roller 7 rises as magnetic chains 25 at a magnetic pole position, the brush tip 26 can come into contact with the developing roller surface 27 and the lowermost layer toner 28 of the magnetic chains 25. When the developing roller 7 is driven for development (developing roller rotation direction R2) in the state in which the brush tip 26 is in contact with the lowermost layer toner 28 of the magnetic chains 25, a force (R6) of moving the lowermost layer toner 28 of the magnetic chains 25 acts on the brush tip 26 due to the rotational driving force of the developing roller 7. In this manner, the lowermost layer toner 28 of the magnetic chains 25 can be moved (rolled) to weaken the force by which the lowermost layer toner 28 adheres to the developing roller surface 27.

When the lowermost layer toner 28 of the magnetic chains 25 is moved by the brush roller 24, charge-transfer occurs in the brush roller 24. Subsequently, the configuration in the first embodiment in which <4> charge-transfer occurs in the toner 3 and the brush roller 24 is described with reference to an enlarged diagram of the lowermost layer toner 28 illustrated in FIG. 8B. The lowermost layer toner 28 has negative charge on its toner surface layer, and strongly adheres to the developing roller surface 27 (reflection force F). On the other hand, the developing roller surface 27 has positive charge corresponding to the negative charge of the toner surface layer. When the brush tip 26 rolls the lowermost layer toner 28 in the R6 direction, the negative charge of the toner surface layer is separated from the developing roller surface 27. As a result, a force (reflection force F') by which the lowermost layer toner 28 adheres to the developing roller surface 27 is weakened.

On the other hand, the brush tip 26 comes into contact with positive charge of the developing roller surface 27 separated from the negative charge of the toner surface layer. At the brush tip 26 which is in contact with the positive charge of the developing roller surface 27, the negative charge starts to transfer toward the brush tip 26 so as to correspond to the positive charge. As a result, the negative charge transfers in the brush 23, and a brush current I can be detected. A method of detecting the brush current I and detection results thereof are described later.

When the toner 3 having high charge amount, which is more liable to stick to the developing roller surface 27, sticks directly to the developing roller surface 27, the toner 3 acts so as not to be charged at a predetermined level or more. In the first embodiment, the lowermost layer toner 28 is moved by the brush roller 24. In this manner, lowermost layer toner 28 having high charge amount and upper layer toner having low charge amount in the toner layer on the developing roller 7 are mixed together, so that the toner layers on the developing roller 7 can be uniformly charged. In this example, the brush roller 24 can be referred to as "charge-transfer promoting means" because the brush roller 24 promotes the charge-transfer in the lowermost layer toner 28 and promotes the uniform charging of the toner layers on the developing roller 7.

The movement of the toner 3 of the magnetic chains 25 described above includes the case where the toner 3 itself rolls without changing the position of the toner 3 in the magnetic chains 25 and the case where the toner 3 moves from a lower layer to an upper layer in the magnetic chains 25. The movement of the toner 3 of the magnetic chains 25 also includes the case where the toner 3 moves to peripheral magnetic chains 25 and the case where the moved toner 3 forms magnetic chains 25 again.

Method of Verifying Agitation

Next, a method of verifying that the lowermost layer toner 28 of the magnetic chains 25 is moved by the brush roller 24 which is in contact with the lowermost layer toner 28 is described. As described above, when the lowermost layer toner 28 is moved and the brush tip 26 comes into contact with the positively-charged developing roller surface 27, negative charge-transfer occurs in the brush roller 24. Thus, a detectable brush current I is generated by moving the lowermost layer toner 28. In other words, the detection of the brush current I verifies that the lowermost layer toner 28 of the magnetic chains 25 has been successfully moved.

On the other hand, in the case of the stripping in the conventional technology, the brush current I may flow similarly to the movement in the first embodiment. However, in the case of the stripping in the conventional technology, a fogging image is generated due to insufficient charging of the toner 3, and hence whether the movement has been effectively performed can be easily checked by checking both the brush current I and the fogging image. Here, the brush current I is detected in the state in which no fogging image is generated.

Figure 9:
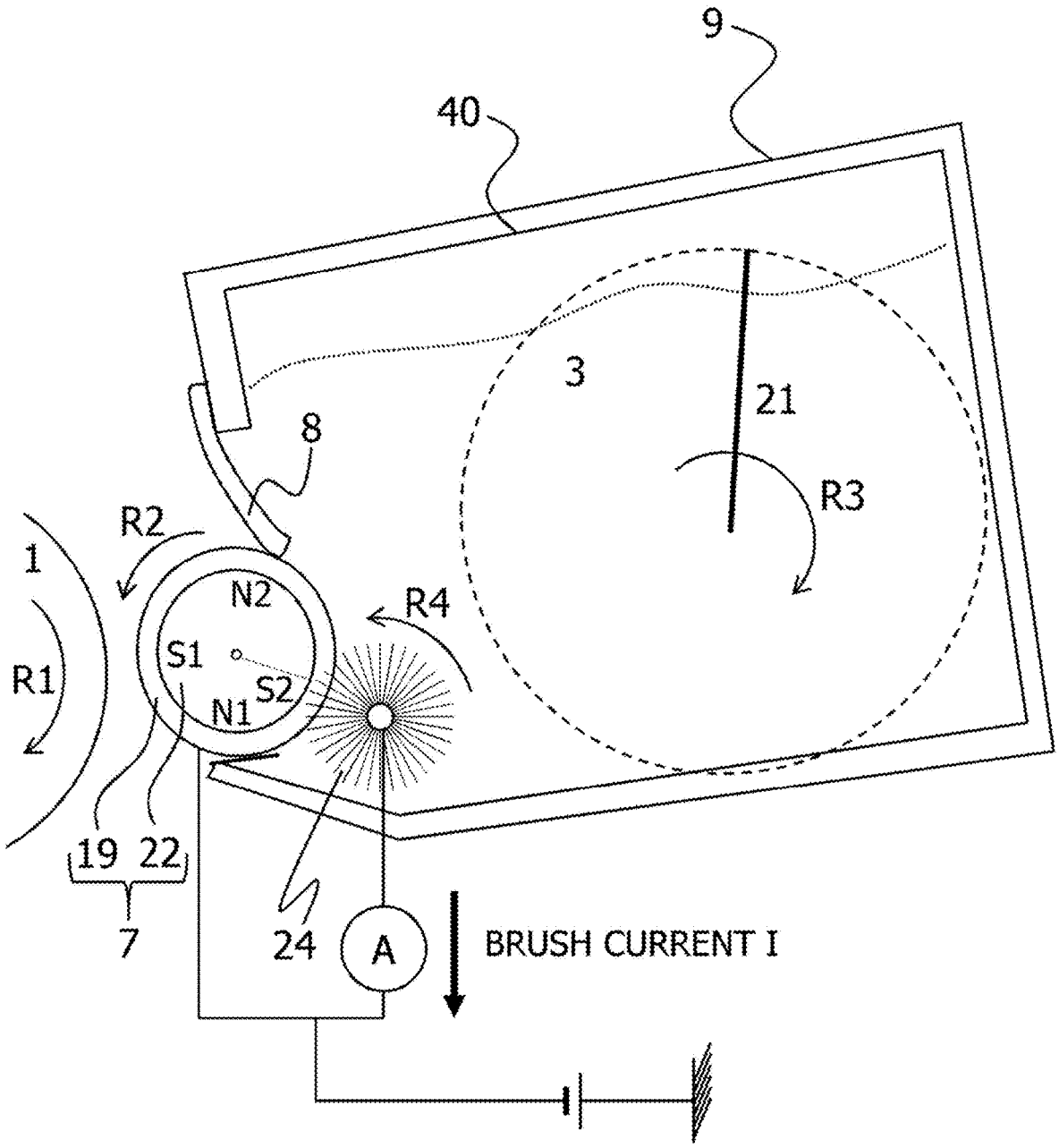
FIG. 9 is a cross-sectional diagram of a developing apparatus having brush current detection means in the first embodiment.

FIG. 9 is a cross-sectional diagram of the developing apparatus having brush current detection means. As the brush current detection means, a current detection circuit is disposed on a brush voltage application side of a high voltage applying means for setting the developing roller 7 and the brush to have the same potential, so that the brush current I is detected.

Figure 10A:
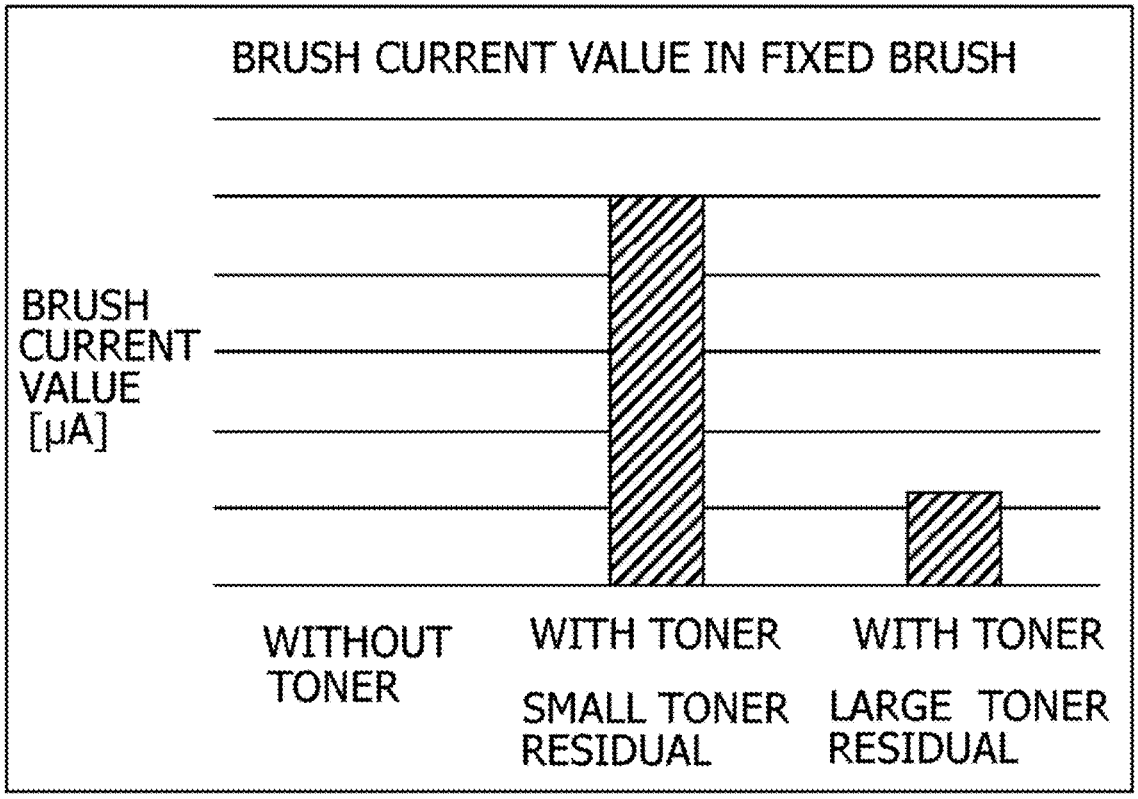
FIG. 10A and FIG. 10B are diagrams illustrating results of brush current in the first embodiment.
Figure 10B:
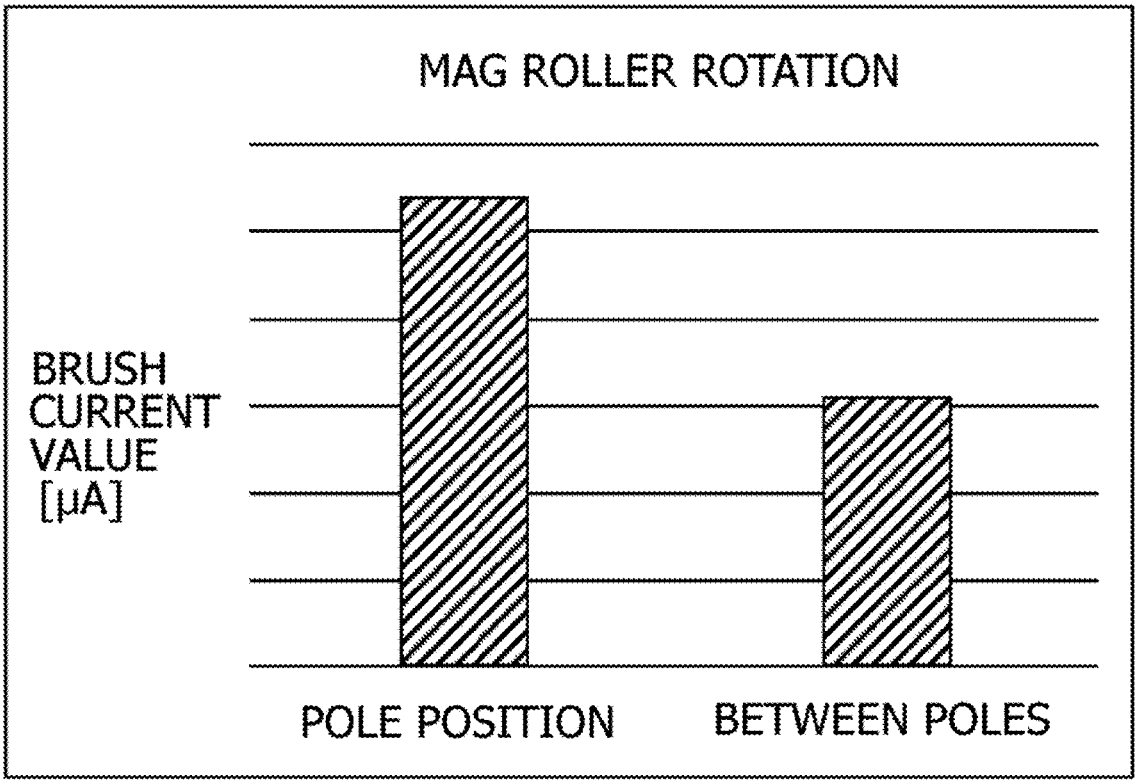

FIG. 10A and FIG. 10B illustrate results of the brush current obtained by the brush current detection means. FIG. 10A illustrates a measurement result of the brush current I when the toner 3 is located near a contact nip between the developing roller 7 and the brush tip 26 and when the toner 3 is not located near the contact nip. FIG. 10B illustrates a measurement result of the brush current I at a magnetic pole position of the magnet roller 22.

As indicated by the measurement result A of the brush current I in FIG. 10A, when the toner 3 is absent, no brush current I flowed even if the brush and the developing roller 7 are brought into contact with each other (0 μA). This result indicates that when the toner 3 is not moved, the charge-transfer or the brush current I does not occur. Next, as indicated by the measurement result A of the brush current I in FIG. 10A, when much toner 3 remained near the contact nip between the developing roller 7 and the brush tip 26 in the state "with toner", the brush current I slightly flowed (0.05 μA). This result indicates that the toner 3 is slightly moved and the charge-transfer occurs. When an image is actually output, a slight restriction failure occurs (Δ). When the amount of toner residual near the contact nip between the developing roller 7 and the brush tip 26 is small in the state "with toner", a large brush current I flowed (0.25 μA). This result indicates that the toner 3 is more greatly moved and the charge-transfer occurs greatly. When an image is actually output, no restriction failure occurs (O).

As indicated by the measurement result B of the brush current I in FIG. 10B, when the S2 pole is shifted by 30 degrees on the downstream side in the rotation direction of the developing roller 7 and the brush roller 24 is disposed between the N1 pole and the S2 pole (between poles), a slight brush current I flowed (0.05 μA). This results indicates that the toner 3 is slightly moved and the charge-transfer occurs. When an image is actually output, a slight restriction failure occurs (A). On the other hand, when the brush roller 24 is disposed at the S2 pole (pole position), a large brush current I flowed (0.25 μA). This result indicates that the toner 3 is more effectively moved and the charge-transfer occurs more greatly when the brush roller 24 is disposed at the pole position. When an image is actually output, no restriction failure occurs (O).

In the first embodiment in which the movement state can be detected by such a brush current detection circuit, the movement conditions are determined depending on the purposes such as required image quality and the durable number of sheets. The reason is that the movement conditions relate to the prevention of sticking of highly-charged toner 3 to the developing roller surface 27 and the local unevenness of charge amount, and an effect for high image quality can be obtained.

Description of Operation Sequence of Developing Roller and Brush Roller

Next, an operation sequence of the developing roller 7 and the brush roller 24 in the first embodiment is described.

Figure 15:
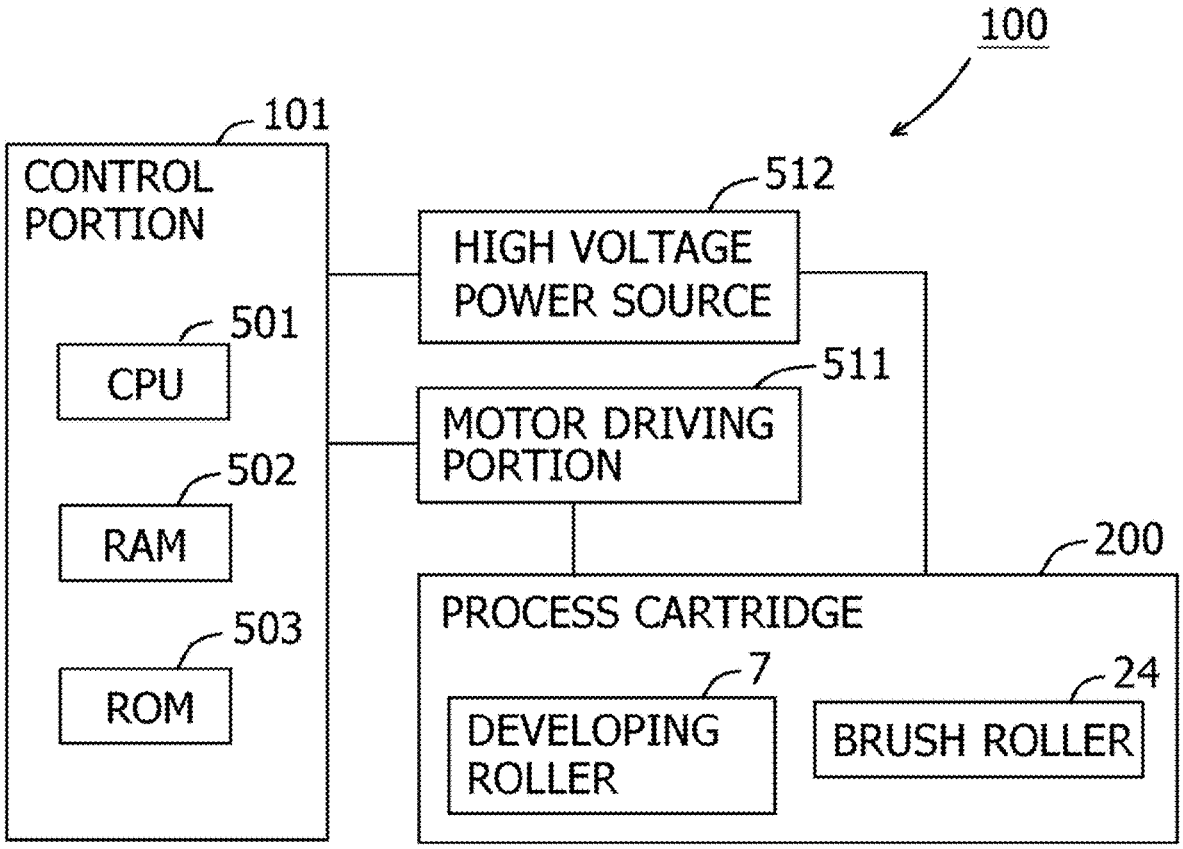
FIG. 15 is a control block diagram of the image forming apparatus according to the first embodiment.

FIG. 15 illustrates an example of a control block diagram of the image forming apparatus 100 in the first embodiment.

A control portion 101 has a central processing unit (CPU) 501 as a central element for performing arithmetic processing. The control portion 101 has a random access memory (RAM) 502 and a read-only memory (ROM) 503 as storage means. The control portion 101 further has an input/output interface (not shown) for inputting and outputting information to and from peripheral devices. In the RAM 502, detection results and arithmetic results of sensors in the image forming apparatus are stored, and in the ROM 503, a control program and a data table for storing various kinds of data used for the control program are stored. The control portion 101 is control means for comprehensively controlling the operation of the image forming apparatus 100, and each control target in the image forming apparatus 100 is connected to the control portion 101 through the input/output interface. The control portion 101 controls the transfer of various kinds of electric information signals and driving timings, and controls flowchart processing described later.

The motor driving portion 511 refers to various kinds of motors, and is a driving power source for rotationally driving the photosensitive drum 1 and the developing roller 7 in the process cartridge 200. The high voltage power source 512 is a power source for applying high voltage to the photosensitive drum 1, the developing roller 7, the transfer roller 11, and the fixing unit 12. The motor driving portion 511 and the high voltage power source 512 operate on the basis of control signals from the control portion 101.

Figure 16A:
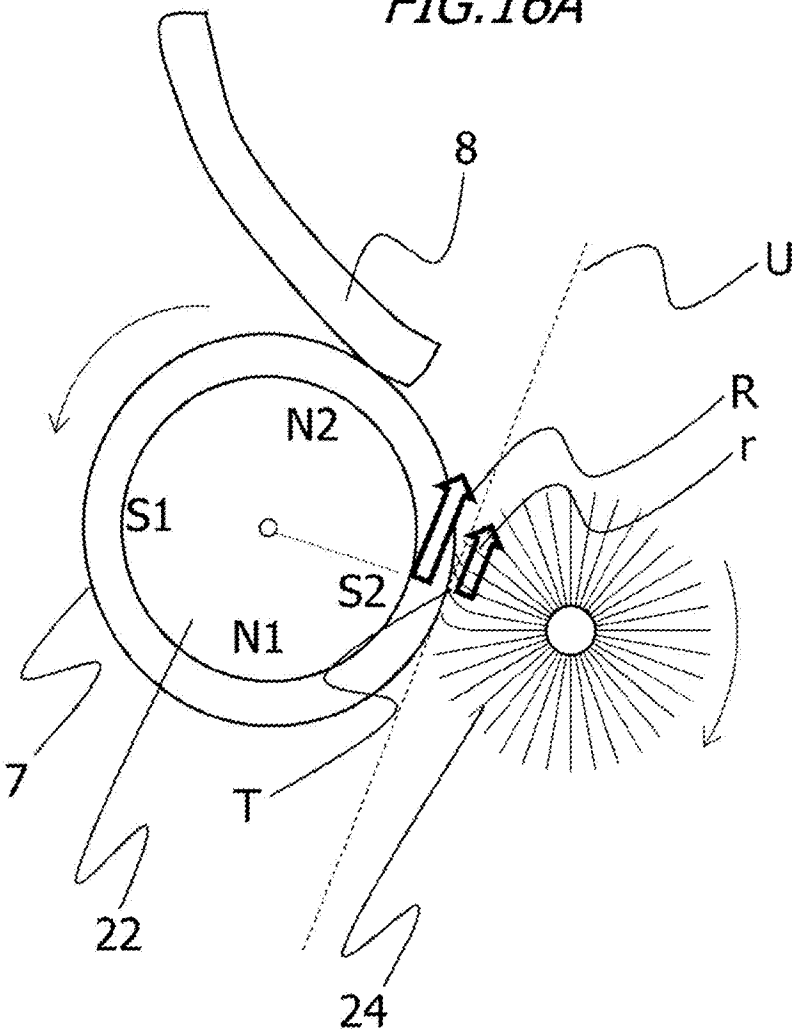
FIG. 16A and FIG. 16B are schematic diagrams related to surface moving speed vectors of the developing roller and the moving member according to the first embodiment.
Figure 16B:
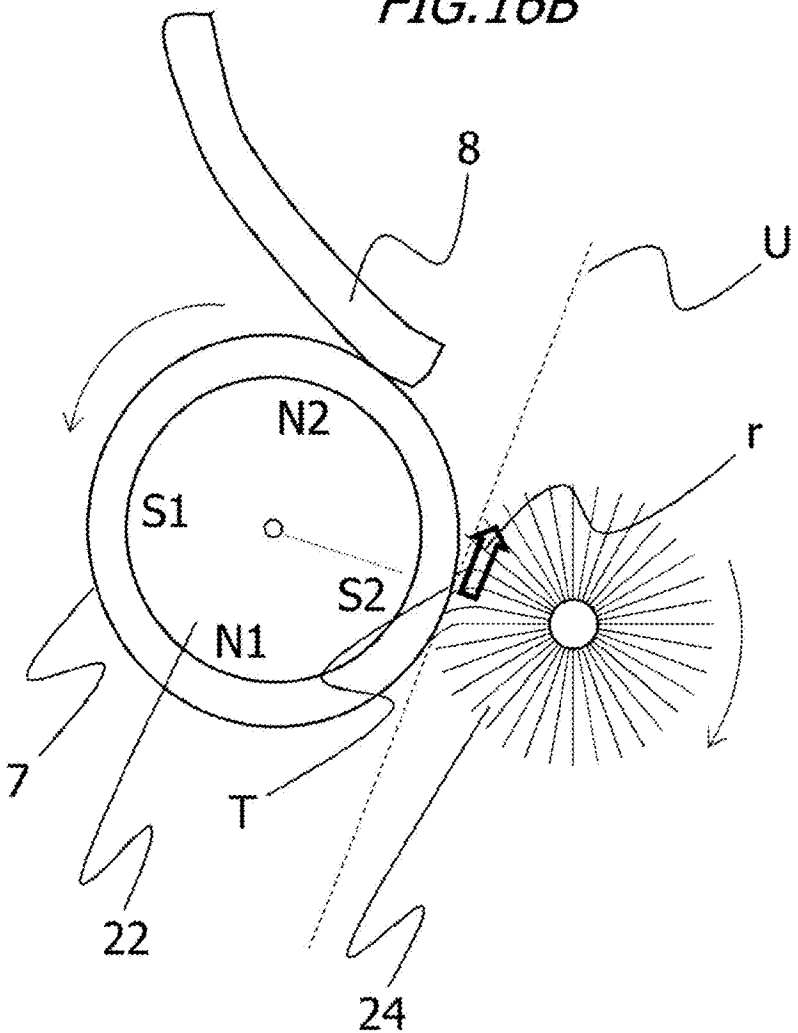

FIG. 16A and FIG. 16B are schematic diagrams illustrating vectors (hereinafter referred to as "surface moving speed vector") related to the moving speeds of the surfaces of the developing roller 7 and the brush roller 24 according to the first embodiment.

In FIG. 16A and FIG. 16B, a tangent at a point T, which is a contact position between the developing roller 7 and the brush roller 24 on the developing roller 7 on a straight line passing through the rotating center of the developing roller 7 and the rotating center of the brush roller 24, is taken as U. A surface moving speed vector of the developing roller 7 at the point T is taken as R, and a surface moving speed vector of the brush roller 24 is taken as r.

As illustrated in FIG. 16A and FIG. 16B, in the first embodiment, the rotation direction of the developing roller 7 during image forming processing is counterclockwise and the rotation direction of the brush roller 24 is clockwise. Thus, the vector R and the vector r are directed in the same direction, and the speed of the developing roller 7 at the point T is larger. The relation between the magnitude (speed) $|R|$ of the vector R and the magnitude (speed) $|r|$ of the vector r is $|R|>|r|$H. For example, in the first embodiment, the speed $|R|$ of the developing roller 7 is 188 mm/sec and the speed $|r|$ of the brush roller 24 is 94 mm/sec.

The relative speed difference of the brush roller 24 with respect to the developing roller 7 can be expressed by $|R|-|r|$, and in the first embodiment, the relative speed difference during image forming processing is expressed by $|R|-|r|>0$. In this case, the brush in the brush roller 24 is in contact in the direction as illustrated in FIG. 16A.

However, when the image forming processing is not being performed, if the brush in the brush roller 24 is in contact with the developing roller 7 as illustrated in FIG. 16B, the contact state of the brush with the developing roller 7 can be reversed between during image forming processing and during non-image forming processing. In the first embodiment, when R=0 (zero vector) is given, $|R|-|r|<0$ is established. This indicates the state in which the rotation of the developing roller 7 is stopped and the brush roller 24 is rotationally driven.

In the first embodiment, in the case where the operation of the developing roller 7 and the brush roller 24 is not controlled during non-image forming processing, it is assumed that after the image forming processing is stopped, the contact state between the developing roller 7 and the brush roller 24 during image forming processing is maintained and left. In this case, the state of toner near a contact nip between the developing roller 7 and the brush roller 24 may change, and a history at the time of the stop of the image forming processing may be left on the developing roller 7. In the first embodiment, by changing the direction of the brush in the contact state of the developing roller 7 and the brush roller 24 between during image forming processing and during non-image forming processing to change the moving direction of the brush, the moving effect during non-image forming processing before the image forming processing is stopped is enhanced. Further, density unevenness in a short direction caused by a history at the time of the stop of the image forming processing can be suppressed. At the same time, the brush linear pressure may decrease depending on the left state after the stop of the image forming processing. In this case, by setting the contact direction of the brush at the time of the stop of the image forming processing to be opposite to the direction during the image forming processing, the decrease in brush linear pressure when the next image forming processing is executed can be suppressed to suppress the decrease in moving effect.

Figure 17:
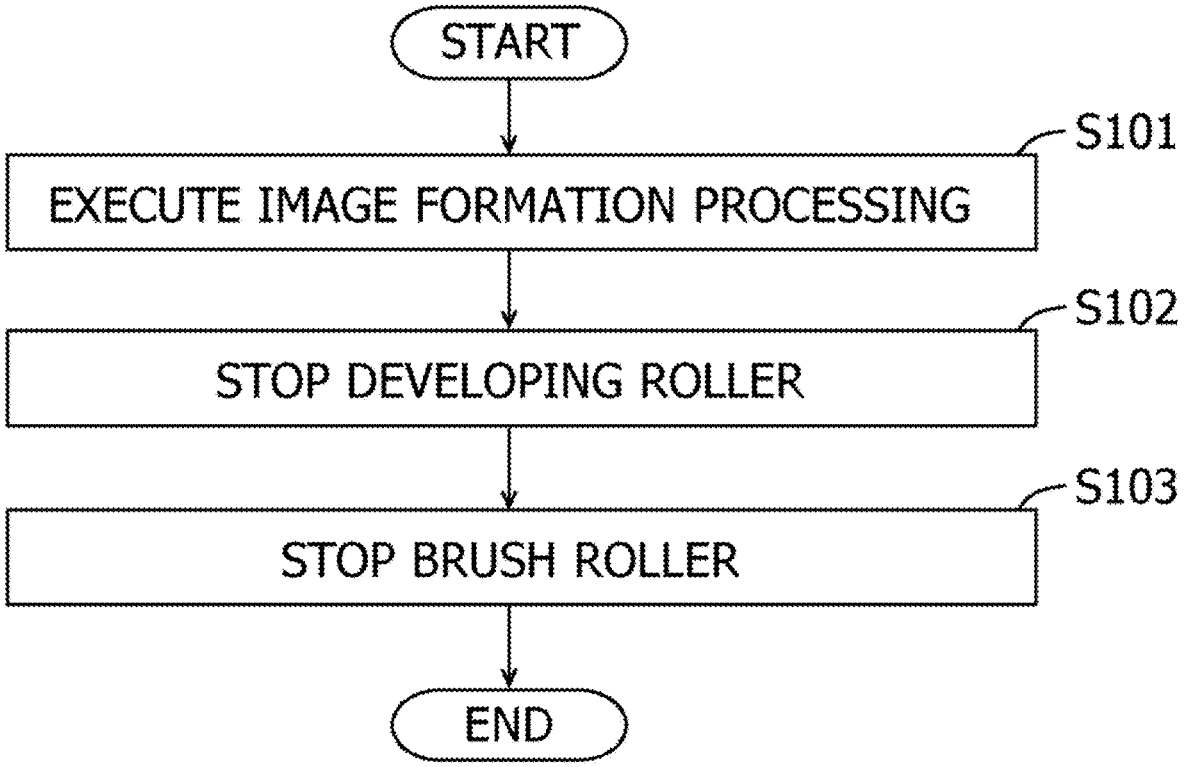
FIG. 17 is an operation sequence according to the first embodiment.

FIG. 17 is a flowchart illustrating an example of an operation sequence of the developing roller 7 and the brush roller 24 according to the first embodiment. Referring to the flowchart, operation control of the developing roller 7 and the brush roller 24 is described below. In the first embodiment, the control portion 101 controls the rotational operation of the developer bearing member and the brush roller 24 such that the direction of the vector R−r during image formation and the direction of the vector R−r during non-image formation other than during the image formation are opposite to each other. In other words, in the first embodiment, the control portion 101 controls the rotational operation of the developer bearing member and the brush roller 24 such that the relative surface moving speed of the brush roller 24 with respect to the developing roller 7 is opposite between during image formation and during non-image formation.

In S101, the control portion 101 executes image forming processing of the image forming apparatus 100. The image forming processing as used herein refers to a cycle of the above-mentioned series of image formation. When the image forming processing is finished, the control portion 101 advances the processing to S102. During the image forming processing, $|R|-|r|>0$ is established, and the contact state of the brush roller 24 with the developing roller 7 is the contact state exemplified in FIG. 16A.

In S102, the control portion 101 instructs the motor driving portion 511 to stop the rotation of the developing roller 7. Next, in S103, the control portion 101 controls the rotational operation of the brush roller 24 through the motor driving portion 511 to stop the brush roller 24. During S102 and S103, the developing roller 7 is stopped and the brush roller 24 is rotationally driven, and hence $|R|-|r|<0$ is established, and the contact state of the brush roller 24 with the developing roller 7 is the contact state exemplified in FIG. 16B. When the brush roller 24 is stopped, the control portion 101 finishes the processing in this flowchart. Until the next image forming processing is started, the brush roller 24 is left in the contact state exemplified in FIG. 16B, and becomes the contact state exemplified in FIG. 16A again when the next image forming processing is started.

In the first embodiment, the operation of the developing roller 7 and the brush roller 24 is controlled such that $|R|-|r|<0$ is established after the image forming processing. However, instead, the operation of the developing roller 7 and the brush roller 24 may be controlled such that $|R|-|r|<0$ is established before the image forming processing. In other words, in any case, the developing roller 7 is stopped and the brush roller 24 is rotationally driven, and hence the control portion 101 only needs to start driving the developing roller 7 after starting the driving of the brush roller 24. The control portion 101 may perform the above-mentioned operation control of the developing roller 7 and the brush roller 24 before the image forming processing and after the image forming processing.

In the above description, the operation of the developing roller 7 and the brush roller 24 is controlled such that $|R|-|r|>0$ is established during image forming processing. When $|R|-|r|<0$ is established during the image forming processing, the operation of the developing roller 7 and the brush roller 24 may be controlled such that $|R|-|r|>0$ is established during non-image forming processing. Specifically, the rotation directions of the developing roller 7 and the brush roller 24 during the execution of the image forming processing are the same as described above, but the speed of the developing roller 7 at the point T is smaller than the speed of the brush roller 24, and hence $|R|<|r|$ is established. Examples of the cases include a case where the speed $|R|$ of the developing roller 7 is 188 mm/sec and the speed $|r|$ of the brush roller 24 is 282 mm/sec. The state where $|R|-|r|>0$ is established during the non-image forming processing is the state where the brush roller 24 is stopped and the developing roller 7 is rotationally driven.

In the first embodiment, only by stopping one of the developing roller 7 and the brush roller 24, the occurrence of image density unevenness caused by a history that may occur at the time of the stop of image forming processing can be suppressed, which enhances the moving effect before and after the stop of the image forming processing. In the case where the rotation direction of the developing roller 7 and the rotation direction of the brush roller 24 are the same, the operation of the developing roller 7 and the brush roller 24 may be controlled such that one of the rotation directions of the developing roller 7 and the brush roller 24 during non-image forming processing is opposite to that during image forming processing. Even such operation control can obtain the same effects as described above.

In the first embodiment, the brush roller 24 is used as a moving member. However, even when a brush which comes into contact with the developing roller 7 and does not rotate is used instead of the brush roller 24, $|r|=0$ can be used. Thus, the same effects can be obtained by controlling the operation of the developing roller 7 such that the rotation direction of the developing roller 7 during non-image forming processing is opposite to that during image forming processing.

Second Embodiment

Next, the second embodiment is described. The second embodiment is different from the first embodiment in the operation sequence of the developing roller 7 and the brush roller 24, but is the same as the first embodiment in other points. Thus, descriptions overlapping with the first embodiment are omitted below.

Figure 18B:
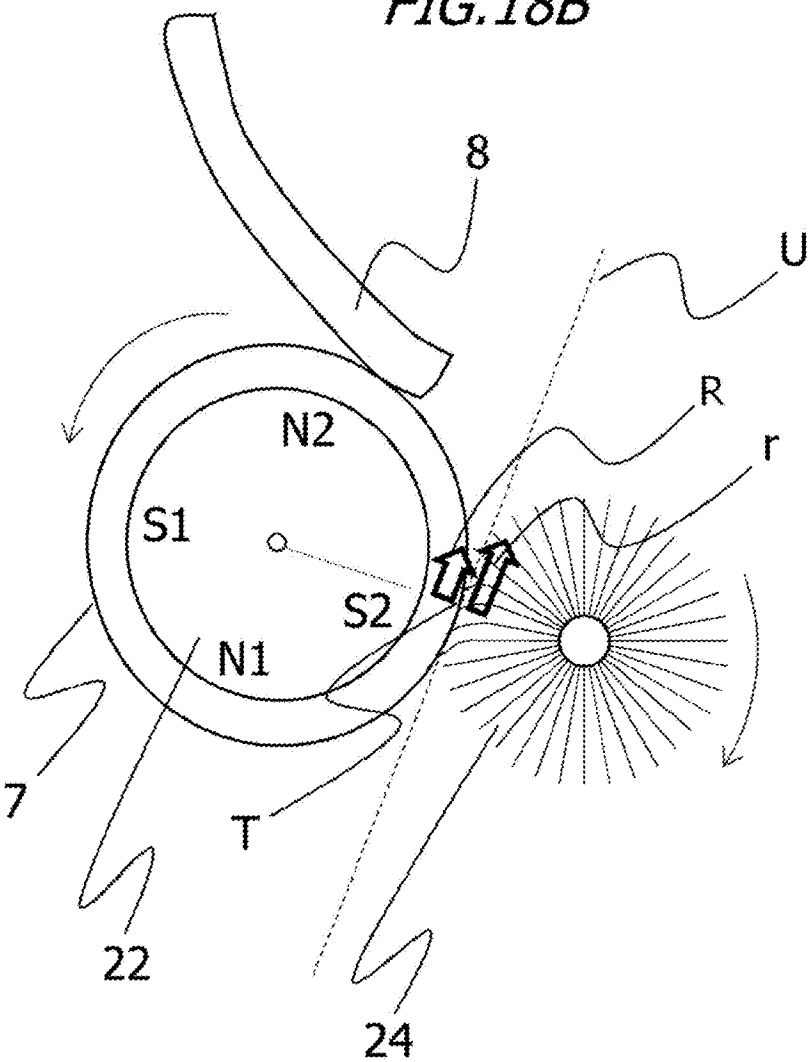
FIG. 18A and FIG. 18B are schematic diagrams related to surface moving speed vectors of the developing roller and the moving member according to a second embodiment.
Figure 18A:
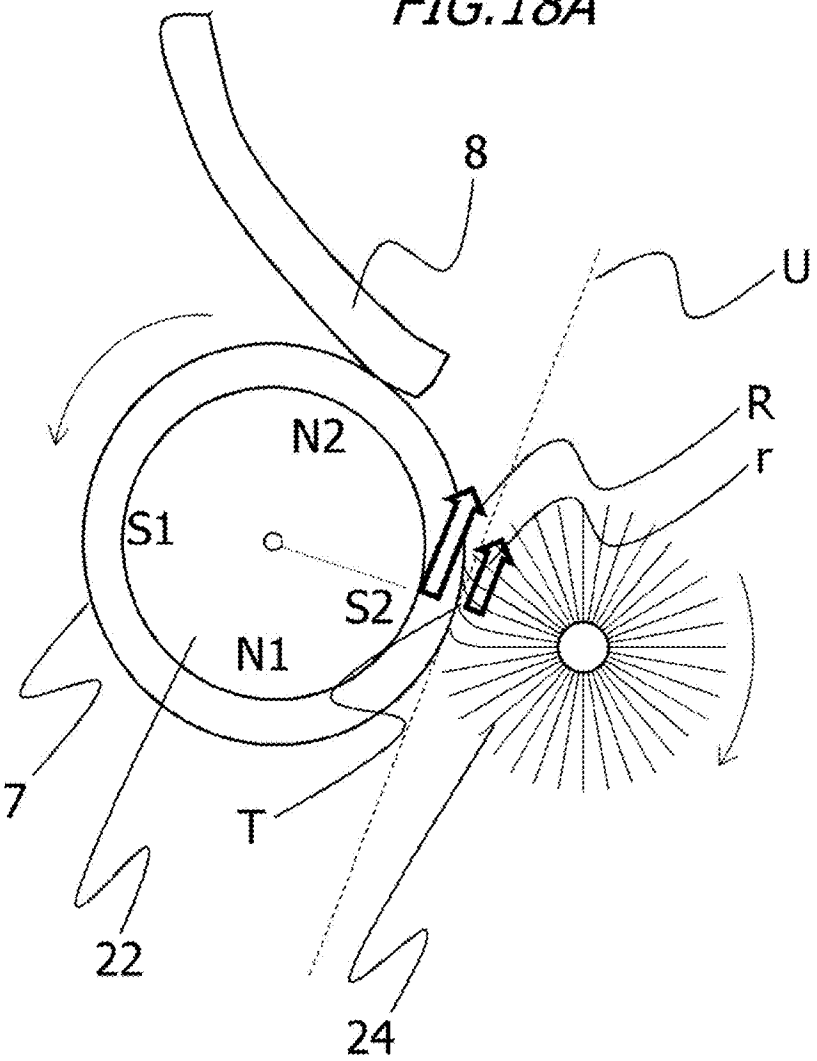

FIG. 18A and FIG. 18B are schematic diagrams related to surface moving speed vectors of the developing roller 7 and the brush roller 24 according to the second embodiment. In FIG. 18A and FIG. 18B, the rotation direction of the developing roller 7 during image forming processing is counterclockwise, and the rotation direction of the brush roller 24 is clockwise. Thus, speed vectors R and r are directed in the same direction, and at a point T, the speed of the developing roller 7 is larger than the speed of the brush roller 24, so that $|R|>|r|$ is established. In the second embodiment, as an example, the speed $|R|$ of the developing roller 7 is 188 mm/sec, and the speed $|r|$ of the brush roller 24 is 94 mm/sec. Thus, in the second embodiment, $|R|-|r|>0$ is established during image forming processing. In this case, the contact state of the brush roller 24 with the developing roller 7 is a contact state exemplified in FIG. 18A.

In the second embodiment, when the contact state of the brush roller 24 with the developing roller 7 becomes a state illustrated in FIG. 18B during non-image forming processing, the contact state of the brush in the brush roller 24 with the developing roller 7 can be reversed between during image forming processing and during non-image forming processing. In the second embodiment, when $|R|<|r|$ is given, $|R|-|r|<0$ is established. This means that, in the case of the above-mentioned example, the rotation of the developing roller 7 has been decelerated such that the rotation speed of the developing roller 7 is smaller than the rotation speed of the brush roller 24, for example, 47 mm/sec. In the second embodiment, the operation of the developing roller 7 and the brush roller 24 is controlled such that the rotation speed of the developing roller 7 and the rotation speed of the brush roller 24 satisfy such a condition during the image forming processing and during the non-image forming processing, so that the same effects as in the first embodiment can be obtained.

Figure 19:
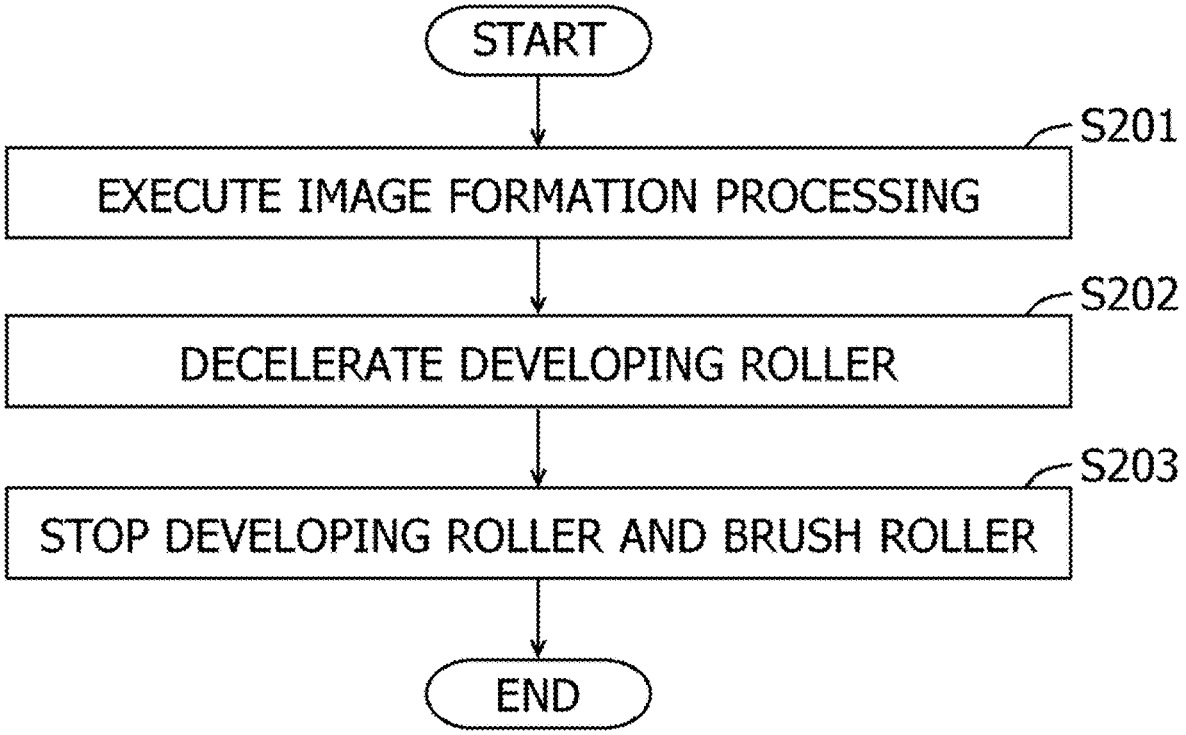
FIG. 19 is an operation sequence according to the second embodiment.

FIG. 19 is a flowchart illustrating an example of an operation sequence of the developing roller 7 and the brush roller 24 according to the second embodiment. Referring to the flowchart, operation control of the developing roller 7 and the brush roller 24 is described below.

In S201, the control portion 101 executes image forming processing of the image forming apparatus 100. The image forming processing as used herein refers to a cycle of the above-mentioned series of image formation. When the image forming processing is finished, the control portion 101 advances the processing to S202. During the image forming processing, $|R|-|r|>0$ is established, and the contact state of the brush roller 24 with the developing roller 7 is the contact state exemplified in FIG. 18A.

In S202, the control portion 101 instructs the motor driving portion 511 to decelerate the rotation of the developing roller 7 such that the rotation speed of the developing roller 7 is smaller than the rotation speed of the brush roller 24. Next, in S203, the control portion 101 instructs the motor driving portion 511 to stop the developing roller 7 and the brush roller 24. During S202 and S203, the rotation speed of the developing roller 7 is larger than the rotation speed of the brush roller 24, and hence $|R|-|r|<0$ is established, and the contact state of the brush roller 24 with the developing roller 7 is the contact state exemplified in FIG. 18B. When the developing roller 7 and the brush roller 24 are stopped, the control portion 101 finishes the processing in this flowchart. Until the next image forming processing is started, the brush roller 24 is left in the contact state exemplified in FIG. 18B, and becomes the contact state exemplified in FIG. 18A again when the next image forming processing is started.

In the second embodiment, the operation of the developing roller 7 is controlled by the control portion 101 such that $|R|-|r|<0$ is established. However, instead, the control portion 101 may control the operation of the developing roller 7 such that $|R|-|r|<0$ is established before the image forming processing. In other words, in any case, the rotation speed of the developing roller 7 is smaller than the rotation speed of the brush roller 24, and hence the control portion 101 only needs to control the operation of the developing roller 7 such that the rotation speed of the developing roller 7 is set to the rotation speed for image formation. The control portion 101 may perform the above-mentioned operation control of the developing roller 7 before the image forming processing and after the image forming processing.

In the above description, the operation of the developing roller 7 and the brush roller 24 is controlled such that $|R|-|r|>0$ is established during the image forming processing, but in the case where $|R|-|r|<0$ is established during the image forming processing, the operation of the developing roller 7 may be controlled such that $|R|-|r|>0$ is established during non-image forming processing. Specifically, the control portion 101 may decelerate the rotation of the developing roller 7 such that the rotation speed of the brush roller 24 is smaller than the rotation speed of the developing roller 7 during non-image forming processing.

According to this disclosure, even in the configuration in which the moving member is disposed in contact with the developing roller, the occurrence of image density unevenness caused by histories at the time of stop can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-116004, filed on Jun. 19, 2018, which is hereby incorporated by reference herein in its entirety.

What is claimed is:

1. A developing apparatus, comprising:

a developer bearing member that encloses a magnet roller having a plurality of magnetic poles and is rotatable;

a wall that forms a developer storing chamber for storing a magnetic developer therein;

a restricting member configured to restrict a layer thickness of the magnetic developer carried on the developer bearing member;

a moving member configured to move the magnetic developer carried on the developer bearing member before the magnetic developer is restricted by the restricting member, the moving member being rotatable and brought into contact with a surface of the developer bearing member, the moved developer being on the developer bearing member after the moving member moves the developer on the developer bearing member; and a control portion configured to control rotational operation of the developer bearing member and the moving member, wherein, at a contact position between the developer bearing member and the moving member, assuming that a moving speed vector of a surface of the developer bearing member is taken as R and a moving speed vector of a surface of the moving member is taken as r, the control portion controls rotational operation of the developer bearing member and the moving member such that a direction of a vector R-r during image formation and a direction of a vector R-r during non-image formation are opposite to each other, and wherein during the image formation, a rotation direction of the developer bearing member and a rotation direction of the moving member are opposite directions, and a rotation speed of the developer bearing member is greater than a rotation speed of the moving member; and during the non-image formation, the developer bearing member is stopped and the moving member rotates.

2. The developing apparatus according to claim 1, wherein the moving member is provided with a brush and a support member for supporting the brush such that a part of the brush contacts the developer bearing member.

3. The developing apparatus according to claim 2, wherein the support member is rotatably provided to the moving member.

4. An image forming apparatus for forming an image on a recording material, comprising:

the developing apparatus according to claim 1; and an image bearing member configured such that, when the magnetic developer is supplied from the developer bearing member, an electrostatic latent image formed on a surface of the image bearing member is developed, and a developer image is formed on the surface of the image bearing member.

5. The developing apparatus according to claim 1, wherein the moving member has a plurality of fibers, and each of the plurality of fibers has one end fixed to the moving member and another end as a free end such that the free end of each of the plurality of fibers is configured to be brought into contact with the surface of the developer bearing member.

6. A developing apparatus, comprising:

a developer bearing member that encloses a magnet roller having a plurality of magnetic poles and is rotatable;

a wall that forms a developer storing chamber for storing a magnetic developer therein;

a restricting member configured to restrict a layer thickness of the magnetic developer carried on the developer bearing member;

a moving member configured to move the magnetic developer carried on the developer bearing member before the magnetic developer is restricted by the restricting member, the moving member being rotatable and brought into contact with a surface of the developer bearing member, the moved developer being on the developer bearing member after the moving member moves the developer on the developer bearing member; and a control portion configured to control rotational operation of the developer bearing member and the moving member, wherein, at a contact position between the developer bearing member and the moving member, assuming that a moving speed vector of a surface of the developer bearing member is taken as R and a moving speed vector of a surface of the moving member is taken as r, the control portion controls rotational operation of the developer bearing member and the moving member such that a direction of a vector R-r during image formation and a direction of a vector R-r during non-image formation are opposite to each other, and wherein during the image formation, a rotation direction of the developer bearing member and a rotation direction of the moving member are opposite to each other, and a rotation speed of the developer bearing member is lower than a rotation speed of the moving member; and during the non-image formation, the moving member is stopped and the developer bearing member rotates.

7. The developing apparatus according to claim 6, wherein the moving member is provided with a brush and a support member for supporting the brush such that a part of the brush contacts the developer bearing member.

8. The developing apparatus according to claim 7, wherein the support member is rotatably provided to the moving member.

9. The developing apparatus according to claim 6, wherein the moving member has a plurality of fibers, and each of the plurality of fibers has one end fixed to the moving member and another end as a free end such that the free end of each of the plurality of fibers is configured to be brought into contact with the surface of the developer bearing member.

10. An image forming apparatus for forming an image on a recording material, comprising:

the developing apparatus according to claim 6; and an image bearing member configured such that, when the magnetic developer is supplied from the developer bearing member, an electrostatic latent image formed on a surface of the image bearing member is developed, and a developer image is formed on the surface of the image bearing member.

* * * * *